US008126369B2

(12) United States Patent
Yoshino

(10) Patent No.: US 8,126,369 B2
(45) Date of Patent: Feb. 28, 2012

(54) IMAGE FORMING APPARATUS AND PROCESS CARTRIDGE

(75) Inventor: Susumu Yoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 266 days.

(21) Appl. No.: 12/392,502

(22) Filed: Feb. 25, 2009

(65) Prior Publication Data

US 2010/0080609 A1 Apr. 1, 2010

(30) Foreign Application Priority Data

Sep. 26, 2008 (JP) ..... 2008-248017

(51) Int. Cl.
*G03G 15/08* (2006.01)

(52) U.S. Cl. .... 399/252; 430/66; 430/108.1; 430/108.2; 430/108.8; 430/109.4; 430/109.5; 430/110.4; 430/58.65; 430/59.6; 399/159

(58) Field of Classification Search ..... 430/66, 430/108.1, 108.2, 108.8, 110.4, 109.4, 109.5, 430/58.65, 59.6; 399/252, 159
See application file for complete search history.

(56) References Cited

U.S. PATENT DOCUMENTS 6,046,348 A 4/2000 Yamada et al.

(Continued)

FOREIGN PATENT DOCUMENTS

JP A-2-166461 6/1990

(Continued)

*Primary Examiner* — Peter Vajda
(74) *Attorney, Agent, or Firm* — Oliff & Berridge, PLC

(57) ABSTRACT

The invention provides an image forming apparatus, comprising: an electrophotographic photoreceptor, a charging unit, an exposure unit, a developing unit, a transfer unit, a fixing unit, and a cleaning unit; the electrophotographic photoreceptor having an outermost layer containing a charge transporting material and at least one curable resin selected from the group consisting of a phenol resin, an epoxy resin and a melamine resin, and the toner having an ammonium ion concentration as determined by ion chromatography of from about 50 ppm to about 300 ppm.

20 Claims, 4 Drawing Sheets

U.S. PATENT DOCUMENTS

| | | | | |
|---|---|---|---|---|
| 2002/0022189 | A1* | 2/2002 | Kawanishi et al. | 430/108.8 |
| 2002/0034701 | A1 | 3/2002 | Morikawa et al. | |
| 2002/0076238 | A1 | 6/2002 | Itami et al. | |
| 2002/0119382 | A1 | 8/2002 | Nakata et al. | |
| 2003/0039913 | A1* | 2/2003 | Kadokura et al. | 430/124 |
| 2003/0049557 | A1 | 3/2003 | Itami et al. | |
| 2003/0186150 | A1* | 10/2003 | Kitani et al. | 430/108.3 |
| 2003/0190540 | A1* | 10/2003 | Shoshi et al. | 430/78 |
| 2003/0190546 | A1 | 10/2003 | Yoshino et al. | |
| 2003/0219667 | A1* | 11/2003 | Matsumoto et al. | 430/108.7 |
| 2004/0265718 | A1* | 12/2004 | Nakamura et al. | 430/108.4 |
| 2007/0166634 | A1* | 7/2007 | Qi et al. | 430/58.7 |
| 2008/0026308 | A1* | 1/2008 | Qi et al. | 430/58.4 |

FOREIGN PATENT DOCUMENTS

| | | |
|---|---|---|
| JP | A-5-188630 | 7/1993 |
| JP | A-11-38656 | 2/1999 |
| JP | A-2001-5207 | 1/2001 |
| JP | A-2002-6527 | 1/2002 |
| JP | A-2002-82466 | 3/2002 |
| JP | A-2002-82469 | 3/2002 |
| JP | A-2003-66637 | 3/2003 |
| JP | A-2003-186215 | 7/2003 |
| JP | A-2003-186234 | 7/2003 |

* cited by examiner

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2008-248017 filed on Sep. 26, 2008.

BACKGROUND

1. Technical Field

The present invention relates to an image forming apparatus and a process cartridge.

2. Related Art

Conventionally, when images are formed by copying machines, laser beam printers, and the like, electrophotographic methods have been generally used. Conventional electrophotographic methods include forming an electrostatic latent image on a photoreceptor by an optical means, developing the latent image in a developing step, transferring the image on a recording material such as recording paper in a transferring step, and fixing the image on the recording material such as recording paper, generally using heat and pressure, in a fixing step. Since the above-mentioned photoreceptor is repeatedly used, a cleaning device is provided in order to remove the residual toner that remains on the photoreceptor after the transfer.

SUMMARY

According to an aspect of the invention, there is provided an image forming apparatus, comprising: an electrophotographic photoreceptor; a charging unit that charges a surface of the electrophotographic photoreceptor; an exposure unit that exposes the charged surface of the electrophotographic photoreceptor to form an electrostatic latent image; a developing unit that develops the electrostatic latent image using a toner to form a toner image; a transfer unit that transfers the toner image from the surface of the electrophotographic photoreceptor to a transfer material or an intermediate transfer medium; a fixing unit that fixes the transferred toner image on a recording material; and a cleaning unit that removes toner remaining on the surface of the electrophotographic photoreceptor after completion of the transfer of the toner image; the electrophotographic photoreceptor having an outermost layer containing a charge transporting material and at least one curable resin selected from the group consisting of a phenol resin, an epoxy resin and a melamine resin, and the toner having an ammonium ion concentration as determined by ion chromatography of from about 50 ppm to about 300 ppm.

BRIEF DESCRIPTION OF THE DRAWINGS

Exemplary embodiments of the present invention will be described in detail based on the following figures, wherein.

DETAILED DESCRIPTION

Figure 1:
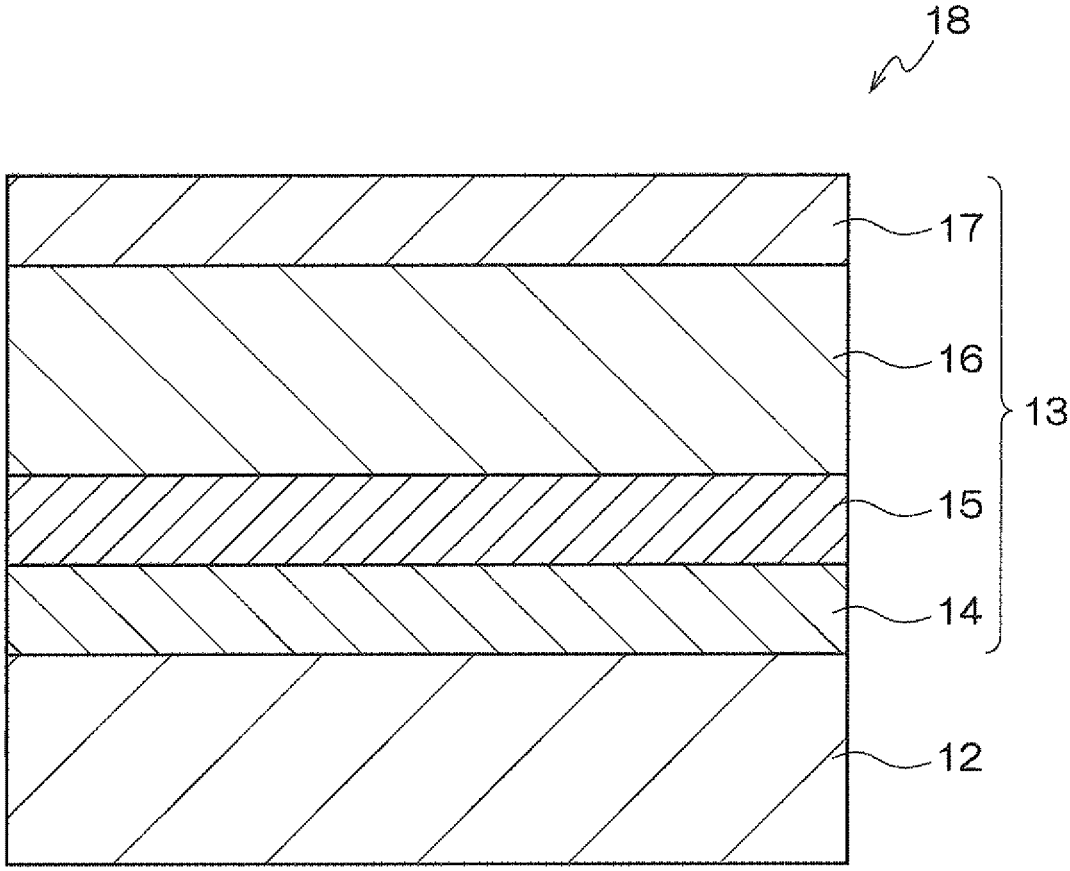
FIG. 1 is a schematic cross-sectional drawing showing an example of a photoreceptor used in the exemplary embodiment.

An image forming apparatus of the exemplary embodiment includes an electrophotographic photoreceptor; a charging unit for charging the surface of the electrophotographic photoreceptor; an exposure unit for forming an electrostatic latent image by exposing the charged electrophotographic photoreceptor; a developing unit for developing the electrostatic latent image by using a toner to form a toner image; a transfer unit for transferring the toner image from the surface of the electrophotographic photoreceptor to a transfer material or an intermediate transfer medium; a fixing unit for fixing the transferred toner image on a recording material; and a cleaning unit for removing the toner remaining on the surface of the electrophotographic photoreceptor after completion of the transfer of the toner image. The electrophotographic photoreceptor has an outermost layer including a charge transporting material and at least one kind of curable resin selected from the group consisting of a phenol resin, an epoxy resin and a melamine resin (hereinafter, sometimes referred to as "specific curable resin"), and the toner has a concentration of ammonium ion determined by ion chromatography of from 50 ppm or more to 300 ppm or less.

The image forming apparatus of the exemplary embodiment was attained based on the findings that the abrasion resistance of the electrophotographic photoreceptor (hereinafter, sometimes referred to as "photoreceptor") is improved by using the outermost layer including a charge transporting material and at least one kind of curable resin selected from the group consisting of a phenol resin, an epoxy resin and a melamine resin for the photoreceptor, and that the discharge products may be effectively removed by using the toner having a concentration of ammonium ion determined by ion chromatography of from 50 ppm or more to 300 ppm or less (hereinafter, sometimes referred to as "specific toner").

Specifically, as mentioned above, it was found that the photoreceptor of the exemplary embodiment may provide significant effects that were never realized before by conventional combinations, by using the combination of the specific photoreceptor and the specific toner, while conventional organic photoreceptors had only a temporary effect that the discharge products may be removed because of scratches due to abrasion and the like. The specific feature of the invention is to incorporate ammonia into the toner.

The discharge products are produced during charging of the photoreceptor by the charging unit, and are generated irrespective of ambient conditions such as temperature and humidity. When the discharge products are adhered to the surface of the photoreceptor, moisture in the atmosphere also adheres thereto, whereby electrical charge is transferred and the electrostatic latent image on the photoreceptor is deformed or diminished. Accordingly, image defects such as image bleeding and white deletion are generated under high humidity. For this reason, removal of the discharge products is necessary regardless of whether humidity is high or low.

A toner including an ammonia component exhibits an effect of removing discharge products, regardless of whether humidity is high or low. It is thought that the polar groups in the binder resin for forming a toner, such as carboxyl groups —COOH, are substituted by ammonia, and the ammonia component exists in a form such as —$COONH_4$ and is relatively stable. Although —COOH itself has relatively strong hydrophilicity due to its polarity, the hydrophilicity of —$COONH_4$ is further increased by the ammonia. Therefore, —$COONH_4$ exhibits hydrophilicity regardless of whether humidity is high or low because of its stable form, and the effect of removing the discharge products is exhibited owing to the affinity of —$COONH_4$ to the discharge products.

During image formation, the toner is rubbed against the photoreceptor in an image development area by a mag brush including a carrier. Furthermore, the toner is subjected to a transfer step whereby transfer residual toner is transferred to a cleaning portion and rubbed against the photoreceptor by a cleaning blade or a cleaning brush. In the present exemplary embodiment, during the rubbing, the discharge products on the photoreceptor are removed by the specific toner including ammonia. As a result, image degradation is suppressed.

In the present exemplary embodiment, the ammonium ion concentration determined by ion chromatography is from 50 ppm or about 50 ppm to 300 ppm or about 300 ppm, preferably from 80 ppm or about 80 ppm to 250 ppm or about 250 ppm, and more preferably from 100 ppm or about 100 ppm to 200 ppm or about 200 ppm, in view of the significant effects obtained as a result, whereby excellent abrasion resistance and properties that prevent image degradation are achieved and an electrophotographic image may be obtained that is stable and maintains favorable quality over the long term. When the concentration is less than 50 ppm or about 50 ppm, the properties that prevent image degradation are impaired, and when the concentration exceeds 300 ppm or about 300 ppm, the charging property of the toner is affected; specifically, the charge amount is reduced and fog is generated on the recording material after long-term use.

The method for incorporating ammonia into the toner is not specifically limited, and examples thereof include: a method including incorporating an ammonia component into a binder resin in advance during the stage of preparing the toner raw material; a method including incorporating ammonia during production of the toner; and a method including immersing ammonia into water during post-treatment after production of the toner.

Hereinafter, details of the electrophotographic photoreceptor used in the exemplary embodiment are explained.

As the photoreceptor used for the exemplary embodiment, a photoreceptor obtained by using a specific curable resin as a component for constituting the outermost layer of the photoreceptor is preferably used for its excellent abrasion resistance.

FIG. 1 is a schematic cross-sectional drawing showing a preferable example of the photoreceptor used for the exemplary embodiment. Electrophotographic photoreceptor 18 shown in FIG. 1 includes a conductive support 12 (volume resistivity at 20° C.: $1\times10^{-6}$ Ωcm or less) and photosensitive layer 13 provided thereon, and the photosensitive layer 13 has a structure in which an undercoating layer 14, charge generating layer 15, charge transporting layer 16 and protective layer 17 are laminated in this order. The protective layer 17 is a functional layer including a specific electrical charge transporting material and a cured product of a specific curable resin.

Hereinafter, the elements of the electrophotographic photoreceptor 18 are explained in detail.

Examples of the conductive support 12 include metal plates, metal drums, and metal belts using metals such as aluminum, copper, zinc, stainless steel, chromium, nickel, molybdenum, vanadium, indium, gold, platinum or alloys thereof, and papers, plastic films and belts which are coated, deposited, or laminated with a conductive compound such as a conductive polymer and indium oxide, a metal such as aluminum, palladium and gold, or alloys thereof.

The surface of the conductive support 12 is preferred to be roughened in order to prevent interference fringes which are formed when irradiated by laser light. The roughness is preferably 0.04 μm to 0.5 μm as a centerline average roughness (Ra).

Preferred examples of the method for surface roughening include wet honing in which an abrasive suspended in water is blown onto a substrate, centerless grinding in which a substrate is continuously ground by pressing the support onto a rotating grind stone, and anodic oxidation. As another method of surface roughening, a method of surface roughening by forming on the substrate surface a layer of resin in which conductive or semiconductive particles are dispersed in the resin so that the surface roughening is achieved by the particles dispersed in the layer, without roughing the surface of the conductive substrate, is also preferably used.

In the surface-roughening treatment by anodic oxidation, an oxide film is formed on an aluminum surface by anodic oxidation in which the aluminum as anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The thickness of the anodic oxide film is preferably 0.3 μm to 15 μm.

Where necessary, the undercoating layer 14 is provided. Specifically, when the conductive support 12 undergoes treatment with an acidic solution or boehmite, it is preferable to form the undercoating layer 14 since the ability of the conductive support 12 to conceal defects tends to be insufficient.

Examples of the material used for the undercoating layer 14 include organic zirconium compounds such as zirconium chelate compounds, zirconium alkoxide compounds and zirconium coupling agents; organic titanium compounds such as titanium chelate compounds, titanium alkoxide compounds and titanate coupling agents; organic aluminum compounds such as aluminum chelate compounds and aluminum coupling agents, as well as organic metal compounds such as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicon alkoxide compounds, aluminum titanium alkoxide compounds and aluminum zirconium alkoxide compounds. Specifically, organic zirconium compounds, organic titanyl compounds and organic aluminum compounds are preferably used since they have low residual potential and show excellent electrophotographic property.

The undercoating layer 14 may further include a silane coupling agent. Examples of the silane coupling agent include vinyltrichlorosilane, vinyltrimethoxysilane, vinyltriethoxysilane, vinyltris 2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, β-3,4-epoxycyclohexyltrimethoxysilane, and the like.

The undercoating layer 14 may further include a binding resin. Examples of the binding resin may include known binding resins such as polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinylpyrrolidone, polyvinylpyridine, polyurethane, polyglutamic acid and polyacrylic acid.

The undercoating layer 14 may further include a charge transporting pigment in order to decrease residual potential and improve environment stability. Examples of the charge transporting pigment include organic pigments described in JP-A No. 47-30330 such as perylene pigments, bisbenzimidazoleperylene pigments, polycyclic quinone pigments, indigo pigments and quinacridone pigment; organic pigments such as bisazo pigments and phthalocyanine pigments containing substituent having electron withdrawing property such as a cyano group, a nitro group, a nitroso group and a halogen atom; and inorganic pigments such as zinc oxide and titanium oxide.

The undercoating layer 14 may further include various fine powder of an organic compound or an inorganic compound in order to improve electrical property, light scattering property, and the like. Specifically, white pigments such as titanium oxide, zinc oxide, zinc flower, zinc sulfate, lead white and lithopone, inorganic pigments as body pigments such as alumina, calcium carbonate and barium sulfate, polyethylene terephthalate resin particles, benzoguanamine resin particles, styrene resin particles, and the like are effective.

The undercoating layer 14 may be formed by applying a coating solution including the above-mentioned constitutional materials on the conductive support 12 and drying. The solvent used for the coating solution for forming the undercoating layer 14 may be any organic solvent as long as it dissolves organic metal compounds and resins and does not cause gellation or aggregation when the charge transporting pigment is mixed or dispersed therein. For example, general organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used solely or as a mixture of two or more kinds. Examples of disperse treatment method of the coating solution may include methods using a roll mill, a ball mill, an oscillation ball mill, an attritor, a sand mill, a colloid mill, a paint shaker, ultrasonic, and the like.

Examples of the application method of the coating solution for forming the undercoating layer 14 may include general methods such as blade coating method, wire bar coating method, spray coating method, immersion coating method, bead coating method, air knife coating method and curtain coating method, Drying after application is performed at the temperature at which the solvent may be evaporated to form a film. The thickness of the undercoating layer 14 is generally from 0.01 μm or more to 30 μm or less, preferably from 0.05 μm or more to 25 μm or less.

The charge generating layer 15 is constituted by comprising a charge generating material and a binding resin. As the charge generating material, known materials including organic pigments such as azo pigments such as bisazo pigments and trisazo pigments; condensed ring aromatic pigments such as dibromoanthanthrone; perylene pigments; pyrrolopyrrole pigments; and phthalocyanine pigments, and inorganic pigments such as trigonal selenium and zinc oxide may be used. Specifically, where expose light having a wavelength of from 380 nm to 500 nm is used for image forming, metal and non-metal phthalocyanine pigments, trigonal selenium, dibromoanthanthrone, and the like are preferably used. Among these, hydroxygallium phthalocyanine disclosed in JP-A Nos. 5-263007 and 5-279591, chlorogallium phthalocyanine disclosed in SP-A No. 5-98181, dichlorotin phthalocyanine disclosed in JP-A Nos. 5-140472 and 5-140473 and titanylphthalocyanine disclosed in JP-A Nos. 4-189873 and 5-43813 are specifically preferable.

The binding resin used in the charge generating layer 15 can be selected from a wide range of insulating resins, and from organic light conductive polymers such as poly-N-vinyl carbazole, polyvinyl anthracene, polyvinyl pyrene, and polysilane. Preferable examples of the binding resin include insulating resins such as polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins but are not limited thereto.

The charge generating layer 15 may be formed by applying the coating solution including the above-mentioned constitutional materials on the undercoating layer 14 and drying. As the solvent used for the coating solution for forming the charge generating layer 15, general organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used solely or as a mixture of two or more kinds.

For the dispersing method for preparing the coating solution for forming the undercoating layer 14, ordinary methods such as ball mill dispersion, attritor dispersion and sand mill dispersion can be used. The dispersing method requires conditions that do not cause deformation of crystals of the pigment (charge generating material). Furthermore, it is effective to adjust the particles size of the pigment particles to 0.5 μm or less during dispersion.

As the method for applying the coating solution for forming the undercoating layer 14, general methods such as blade coating method, wire bar coating method, spray coating method, immersion coating method, bead coating method, air knife coating method and curtain coating method may be used. Drying after application is performed at the temperature at which the solvent may be evaporated to form a film. The thickness of the charge generating layer 15 is generally from 0.1 μm or more to 5 μm or less.

The charge transporting layer 16 is formed by including a charge transporting material and a binding resin, or including a polymer charge transporting material.

Examples of the charge transporting material include electron transporting compounds such as quinone-based compounds such as p-benzoquinone, chloranil, bromanil, and anthraquinone, tetracyanoquinodimethane-based compounds, fluorenone compounds such as 2,4,7-trinitro fluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl substituted ethylene-based compounds, stilbene-based compounds, anthracene-based compounds, and hydrazone-based compounds, but are not limited thereto. These charge transporting materials may be used alone or in combination of two or more kinds thereof.

Examples of the binding resin used for the charge transporting layer 16 may include polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins and styrene-alkyd resins. These binding resins may be used solely by one kind or as a mixture of two or more kinds.

As the polymer charge transporting material, known materials having charge transporting properties such as poly-N-vinyl carbazole and polysilane can be used. Polyester-based polymer charge transporting materials disclosed in JP-A Nos. 8-176293 and 8-208820, having high charge transporting properties, are particularly preferred. Charge transporting polymer materials can be used as a material for charge transporting layer 16 independently, but may also be mixed with the above-described binding resin to form a film.

The charge transporting layer 16 may be formed by applying the coating solution including the above-mentioned constitutional materials on the charge generating layer 15 and drying. As the solvent used for the coating solution for forming the charge transporting layer, general organic solvents such as aromatic hydrocarbons such as benzene, toluene, xylene and chlorobenzene; ketones such as acetone and 2-butanone; halogenated aliphatic hydrocarbons such as methylene chloride, chloroform and ethylene chloride, and cyclic or linear ethers such as tetrahydrofuran and ethyl ether. These solvents may be used solely by one kind or as a mixture of two or more kinds.

As the method for applying the coating solution for forming the charge transporting layer 16, general methods such as blade coating method, wire bar coating method, spray coating method, immersion coating method, bead coating method, air knife coating method and curtain coating method may be used. Drying after application is performed at the temperature at which the solvent may be evaporated to form a film. The thickness of the charge transporting layer 16 is preferably from 5 μm or more to 50 μm or less, more preferably from 10 μm or more to 30 μm or less.

Furthermore, additives such as antioxidant, light stabilizer and heat stabilizer may be added to the charge transporting layer 16 and the like, in order to prevent ozone and oxidic gas generated in the image forming apparatus or degeneration of the photoreceptor by light and heat. Examples of the antioxidizing agent include hindered phenols, hindered amines, paraphenylenediamine, arylalkanes, hydroquinone, spirochromane and spiroindanone, and derivatives thereof, organic sulfur compounds, organic phosphorus compounds, and the like. Examples of the photostabilizing agent include derivatives of benzophenone, benzotriazole, dithiocarbamate, tetramethylpiperidine, and the like.

Furthermore, the photosensitive layer 13 may include at least one kind of electron acceptable substance in order to improve sensitivity, decrease residual potential and to decrease fatigue after repetitive use.

Examples of the electron acceptable substance may include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranyl, dinitroanthraquinone, trinitrofluorenone, picric acid, o-nitrobenzoic acid, p-nitrobenzoic acid and phthalic acid. Among these, fluorenone derivatives, quinone derivatives, and benzene derivatives containing substituent having electron withdrawing property such as Cl, CN and $NO_2$ are specifically preferable.

As mentioned above, the protective layer 17 includes a charge transporting material and at least one kind of curable resin selected from the group consisting of a phenol resin, an epoxy resin and a melamine resin.

The phenol resin, epoxy resin and melamine resin included in the protective layer 17 are not specifically limited as long as they are curable, and may be heat-curable or light-curable. In the exemplary embodiment, it is preferable to use a thermosetting resin in view of abrasion resistance.

Examples of the phenol resin include those obtained from monomers such as monomethylol phenols, dimethylol phenols and trimethylol phenols, and mixtures and oligomers thereof and mixtures of the monomer and oligomer. Such phenol resin is obtained by reacting a compound having a phenolic structure such as resorcine, bisphenols; substituted phenols having one hydroxyl group such as phenol, cresol, xylenol, paraalkylphenols and paraphenylphenol; substituted phenols having two hydroxyl groups such as cathecol, resorcinol and hydroquinone; bisphenols such as bisphenol A and bisphenol Z, and biphenols, with formaldehyde, paraformaldehyde or the like, in the presence of an acid catalyst or an alkaline catalyst.

As the phenol resin, those generally commercially available as a phenol resin may be used. These phenol resins may be used as a combination of two or more kinds. The phenol resin is preferably a resol-type phenol resin that crosslinks by itself in view of abrasion resistance.

Examples of the epoxy resin include bisphenol A type epoxy resins, bisphenol F type epoxy resins, bisphenol S type epoxy resins, phenol-novolak type epoxy resins, cresol-novolak type epoxy resins, bisphenol A-novolak type epoxy resins, bisphenol F-novolak type epoxy resins, alicyclic epoxy resins, glycidyl ester type epoxy resins, glycidyl amine type epoxy resins, hydantoin type epoxy resins, isocyanurate type epoxy resins and aliphatic chain epoxy resins. These epoxy resins may be halogenated or hydrogenated. Furthermore, these epoxy resins may be used as a combination of two or more kinds.

As the melamine resin, various resins such as methylol type resins having unmodified methylol groups, full ether type resins in which all methylol groups have been alkyl-etherified, full imino type resins, and mix type resins having methylol and imino groups may be used. Among these, ether type resins are preferable in view of stability of the coating solution.

The protective layer 17 includes a charge transporting material. Since the electrical charge transporting material is incorporated, electrophotographic property, mechanical strength, charging property, and the like of the electrophotographic photoreceptor may further be enhanced. As a result, excessive abrasion is suppressed.

As the electrical charge transporting material included in the protective layer 17, those being compatible with the specific curable resin used are preferable, and those form chemical bonds with the specific curable resin used are more preferable.

Preferable examples of the electrical charge transporting material included in the protective layer 17 include electrical charge transporting materials having at least one kind of functional group selected from the group consisting of a hydroxyalkyl group, a hydroxyalkoxy group, a hydroxyalkylthio group, and a hydroxyphenyl group optionally having substituents.

Hereinafter, the electrical charge transporting material having at least one kind of functional group selected from the group consisting of a hydroxyalkyl group, a hydroxyalkoxy group, a hydroxyalkylthio group, and a hydroxyphenyl group optionally having substituents is explained.

The charge transporting material preferably has at least one substituent selected from the group consisting of —OH, —$OCH_3$, —$NH_2$, —SH, and —COOH. The charge transporting material particularly preferably has at least two (more preferably three) substituents selected from the group consisting of —OH, —$OCH_3$, —$NH_2$, —SH, and —COOH. As the increase of the number of the reactive functional group (substituent) of the specific charge transporting material, the crosslinking density increases, and the strength of the crosslinked film increased. In particular, the running torque of the electrophotographic photoreceptor for a blade cleaner is reduced, which reduces damages to the blade, and wear of the electrophotographic photoreceptor. The reason of this is not known, but is probably due to that the increase of the number of the reactive functional groups increases the crosslinking density of the cured film, and the molecular motion on the outermost surface of the electrophotographic photoreceptor is suppressed and the interaction with the molecules on the surface of the blade member is weakened.

The specific charge transporting material is preferably the compound represented by the formula (I):

$$F—((—R_1—X)_{n1}R_2—Y)_{n2} \quad (I)$$

wherein in the formula (I), F represents an organic group derived from a hole transporting compound, $R_1$ and $R_2$ each independently represent a linear or branched alkylene group having 1 to 5 carbon atoms, n1 represents 0 or 1, and n2 represents an integer of 1 to 4, X represents an oxygen, NH, or sulfur atom, and Y represents —OH, —$OCH_3$, —$NH_2$, —SH, or —COOH.

Wherein in the formula (I), the organic group represented by F is preferably derived from a hole transporting compound such as an arylamine derivative. Preferable examples of the arylamine derivative include triphenylamine derivatives, and tetraphenylbenzidine derivatives.

The compound represented by the formula (I) is preferably the compound represented by the formula (II). The compound represented by the formula (II) is excellent in, in particular, stability toward charge mobility and oxidation.

(II)

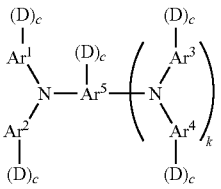

Wherein in the formula (II), $Ar^1$ through $Ar^4$ may be the same or different from each other and each independently represent a substituted or unsubstituted aryl group, $Ar^5$ represents a substituted or unsubstituted aryl group or a substituted or unsubstituted arylene group, D represents —(—$R_1$—X)$_{n1}$$R_2$—Y, c represents 0 or 1, k represents 0 or 1, the total number of D is 1 or more and 4 or less; $R_7$ and $R_8$ each independently represent a linear or branched alkylene group having 1 to 5 carbon atoms, n1 represents 0 or 1, X represents oxygen, NH, or sulfur atom, and Y represents —OH, —$OCH_3$, —$NH_2$, —SH, or —COOH.

Wherein in the formula (II), "—(—$R_1$—X)$_{n1}$$R_2$—Y" represented by D is the same as that in the formula (I), and $R_1$ and $R_2$ each independently represent a linear or branched alkylene group having 1 to 5 carbon atoms n1 is preferably 1. X is preferably oxygen. Y is preferably a hydroxy group. The total number of D in the formula (II) corresponds to n2 in the formula (I), is preferably 2 or more and 4 or less, and more preferably 3 or more and 4 or less. In the formulae (I) and (II), when the total number of D is preferably 2 or more and 4 or less, and more preferably 3 or more and 4 or less in one molecule, the crosslinking density increases, and thus a stronger crosslinked film is formed. In particular, the running torque of the electrophotographic photoreceptor for a blade cleaner is reduced, which reduces damages to the blade, and wear of the electrophotographic photoreceptor. The reason of this is not known, but is probably due to that the increase of the number of the reactive functional groups increases the crosslinking density of the cured film, and the molecular motion on the outermost surface of the electrophotographic photoreceptor is suppressed and the interaction with the molecules on the surface of the blade member is weakened.

Wherein in the formula (II), $Ar_1$ through $Ar_4$ are preferably represented by any one from the formulae (1) through (7). The formulae (1) through (7) are shown together with "-$(D)_c$" which may be linked to $Ar_1$ through $Ar_4$.

(1)

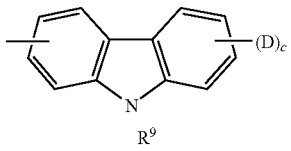

(2)

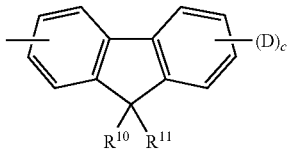

(3)

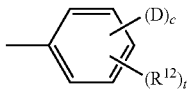

(4)

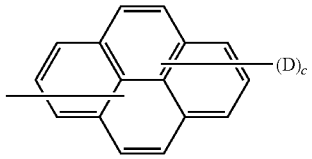

(5)

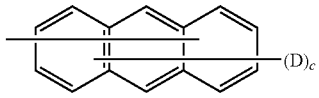

(6)

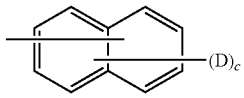

(7)

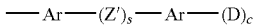

In the formulas (1) to (7), $R^9$ is one kind selected from the group consisting of a hydrogen atom, an alkyl group having 1 to 4 carbon atoms a phenyl group substituted by an alkyl group having 1 to 4 carbon atoms or an alkoxy group having 1 to 4 carbon atoms, an unsubstituted phenyl group, and an aralkyl group having 7 to 10 carbon atoms, $R^{10}$ to $R^{12}$ each independently represent one kind selected from the group consisting of a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom, Ar represents a substituted or unsubstituted arylene group, D and c are the same as the "D" and "c" in the formula (II), each s represents 0 or 1, and t represents an integer of 1 to 3.

The Ar for the formula (7) is preferably one represented by the following formula (8) or (9).

(8)

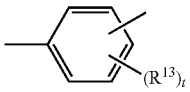

(9)

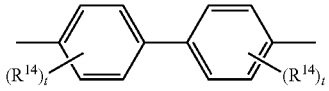

In the formulas (8) and (9), $R^{13}$ and $R^{14}$ each independently represent one kind selected from the group consisting of a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom, and t represents an integer of 1 to 3.

The Z' in the formula (7) is preferably one represented by any of the following formulas (10) to (17).

(10) $-(CH_2)_q-$

(11) $-(CH_2CH_2O)_r-$ (12)

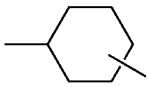

(13)

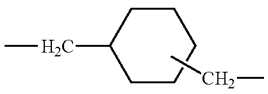

(14)

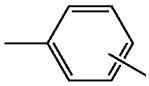

(15)

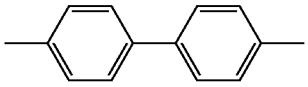

(16)

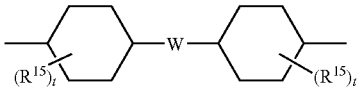

(17)

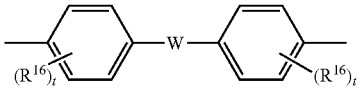

In the formulas (10) to (17), $R^{15}$ and $R^{16}$ each independently represent one kind selected from the group consisting of a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom, W represents a divalent group, q and r each independently represent an integer of 1 or more and 10 or less, and each t represents an integer of 1 to 3.

Wherein in the formulae (16) and (17), W is preferably a divalent group represented by any one of the formulae (18) through (26). In the formula (25), u represents an integer from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

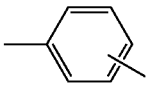

(25)

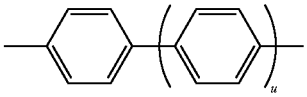

(26)

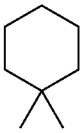

In the formula (II), when k is 0, $Ar^5$ is an aryl group exemplified in the explanation of $Ar_1$ to $Ar^4$ in the above-mentioned (1) to (7), or when k is 1, $Ar^5$ is an arylene group obtained by removing predetermined hydrogen atoms from the aryl group as defined in the above-mentioned (1) to (7).

For the contents of the above-mentioned electrical charge transporting material and specific curing resin in the protective layer 17, the content of the electrical charge transporting material is preferably from 45 parts by weight or more to 215 parts by weight or less, more preferably from 65 parts by weight or more to 150 parts by weight or less, with respect to 100 parts by weight in total of the specific curing resin. When the content is less than 45 parts by weight, residual potential may be increased, and when the content exceeds 215 parts by weight, abrasion resistance may be decreased.

It is preferable that the protective layer 17 includes conductive inorganic particles besides the above-mentioned constitutional materials, in order to improve electrical property.

Examples of the conductive inorganic particles include metal particles, metal oxide particles, carbon black, and the like. Examples of the metal particles include particles made of aluminum, zinc, copper, chromium, nickel, silver, stainless, and the like, plastic particles on which these metals are deposited on the surface, and the like. Examples of the metal oxide particles include particles made of zinc oxide, titanium oxide, tin oxide, antimony oxide, indium oxide, bismuth oxide, tin-doped indium oxide, antimony- or tantalum doped tin oxide, antimony-doped zirconium oxide, and the like.

The average particle size of the conductive particles is preferably 0.3 μm or less, specifically preferably 0.1 μm or less, in view of transparency of the protective layer. Specifically, among the above-mentioned conductive inorganic particles, metal oxides are preferable for the invention in view of transparency. Furthermore, it is preferable to treat the surfaces of the particles in order to control dispersing property and the like. Examples of the agent for the treatment include silane coupling agents, silicone oils, siloxane compounds, surfactants, and the like. Preferably, these agents include fluorine atoms.

The protective layer 17 may optionally include additives such as plasticizers, surface modifying agents, antioxidants and photodegradation inhibitors.

Examples of the plasticizer include for example, biphenyl, biphenyl chloride, terphenyl, dibutyl phthalate, diethyleneglycol phthalate, dioctyl phthalate, triphenyl phosphate, methylnaphthalene, benzophenone, chlorinated pallafin, polypropylene, polystyrene, various fluorohydrocarbons, and the like.

Examples of the surface modifying agent include for example, leveling agents such as silicone oil and fluorine oil, and the like.

As the antioxidizing agent, antioxidants those having a partial structure of hindered phenol, hindered amine, thioether or phosphate, and the like are preferably used in view of improvement of stability in electrical potential and image quality under environment changes. Examples of the hindered phenol antioxidizing agent include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzylphosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, 4,4'-butylidenebis(3-methyl-6-t-butylphenol), and the like.

Furthermore, various particles may be added to form the protective layer 17 in order to control stain resistance, lubricity, hardness, and the like of the surface of the electrophotographic photoreceptor. An example of the particles is silicon-containing particles. The silicon-containing particles include silicon as the constituent element, and specific examples thereof include colloidal silica and silicone particles. The colloidal silica used as silicon-containing particles is a dispersion of silica having an average particle diameter of 1 nm or more and 100 nm or less, preferably 10 nm or more and 30 nm or less in an acidic or alkaline aqueous dispersion, or an organic solvent such as alcohol, ketone, or ester, and may be commercially available one. The solid content of the colloidal silica in the curable resin composition is not particularly limited, but preferably 0.1% by weight or more and 50% or less by weight, preferably 0.1% by weight or more and 30% or less by weight with respect to the total solid content of the curable resin composition from the viewpoints of film-forming ability, electrical characteristics, and strength.

The silicone particles used as the silicon-containing particles are spherical, and preferably have a volume average particle diameter of 1 to 500 nm, more preferably 10 to 100 nm, and may be selected from the common commercially available products of silicone resin particles, silicone rubber particles and silicone surface-treated silica particles. By using the silicone particles, the surface properties of an electrophotographic photoreceptor can be improved without inhibiting the crosslinking reaction, since the particles can exhibit an excellent dispersibility to resin because of being small in diameter and chemically inactive, and further, the content of the silicone particles required to achieve desirable characteristics is small. More specifically, the particles are incorporated uniformly into the strong crosslinking structure, and thereby enhancing the lubricity and water repellency of the surface of the electrophotographic photoreceptor, and maintaining the favorable abrasion resistance and stain resistance over the long time. The content of the silicone particles in the curable resin composition is preferably 0.1 to 30% by weight, more preferably 0.5 to 10% by weight relative to the total solid content in the curable resin composition.

Other examples of the particles include; fluorine particles such as ethylene tetrafluoride, ethylene trifluoride, propylene hexafluoride, vinyl fluoride, and vinylidene fluoride; the particles as described in the proceeding of the 8th Polymer Material Forum Lecture, p. 89, the particles composed of a resin prepared by copolymerization of a fluorocarbon resin with a hydroxy group-containing monomer; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO.

Furthermore, silicone oils other than polyether-modified silicone oils may also be added to the protective layer 17 in order to control stain resistance, lubrisity, hardness, and the like of the surface of the electrophotographic photoreceptor. Examples of the silicone oil may include silicone oils such as dimethylpolysiloxane, diphenylpolysiloxane and phenylmethylsiloxane; reactive silicone oils such as amino-modified polysiloxanes, epoxy-modified polysiloxanes, carboxyl-modified polysiloxanes, carbinol-modified polysiloxanes, methacryl-modified polysiloxanes, mercapto-modified polysiloxanes and phenol-modified polysiloxanes; and the like. The oil may be added in advance to the curable resin composition for forming the protective layer 17, or impregnated into the photoreceptor under reduced pressure or under pressure, after the preparation of the photoreceptor.

Furthermore, the protective layer 17 that is the outermost layer of the photoreceptor of the exemplary embodiment may include a leveling agent such as silicone oil in order to improve surface smoothness of the electrophotographic photoreceptor 18.

The protective layer 17 is formed by applying a coating solution for forming the protective layer 17. Examples of the solvent used for the coating solution include alcohols such as methanol, ethanol, propanol and butanol; ketones such as acetone and methyl ethyl ketone; ethers such as tetrahydrofuran, diethyl ether and dioxane, and the like. These solvents may be used as a combination of two or more kinds. In the exemplary embodiment, those having a boiling temperature of 100° C. or less are preferable.

The content of the solvent in the coating solution for forming the protective layer 17 may be optionally adjusted, however, when the content of the solvent is too small, the solid content tends to be precipitated. Therefore, it is preferably 0.5 to 40 parts by weight, more preferably 1 to 30 parts by weight, with respect to 1 part by mass of the solid content.

The content of the above-mentioned electrical charge transporting material with respect to the specific curing resin in the coating solution for forming the protective layer 17 is preferably 100 parts by weight or more and 10000 parts by weight or less, more preferably 200 parts by weight or more and 5000 parts by weight or less of the electrical charge transporting material, with respect to the total 100 parts by weight of the above-mentioned resin. Where the content is less than 100 parts by weight, the residual potential may be increased, and where the content exceeds 10000 parts by weight, the abrasion resistance may be decreased.

Examples of the method for applying the coating solution for forming the protective layer 17 include blade coating method, Mayer bar coating method, spray coating method, immersion coating method, bead coating method, air knife coating method, curtain coating method, and the like. The film thickness of the protective layer 17 is preferably from 0.1 μm to 100 μm.

The reaction temperature and reaction time for forming the protective layer from the applied film of the above-mentioned coating solution vary according to the kinds of raw materials to be used, and may be generally 10 minutes to 100 hours, and at a temperature of from 0° C. to 100° C. Where the reaction time increases, gellation occurs readily.

Although the exemplary embodiment in which the protective layer is the outermost layer is explained above, in the case when the protective layer is absent, the layer provided on the outermost includes the charge transporting material and the specific curable resin.

Hereinafter, the toner used for the exemplary embodiment is explained. In the full-color copying machines and printers that have enjoyed widespread use in recent years, the problem exists, for example, that a device for providing an offset-prevention agent is required for a heat fixing roll or a fixing belt in the fixing step in order to prevent contamination by toner components and offset. This runs counter to downsizing and weight saving. Furthermore, the offset-prevention agent may evaporate during heating to give off an unpleasant smell and cause contamination in machines. Therefore, it is preferable that the toner includes a releasing agent in order to obtain an excellent fixing property substantially without using an offset-prevention agent.

It is preferable that the releasing agent melts at a temperature of from 70° C. or about 70° C. to 140° C. or about 140° C., exhibits melt viscosity of from 1 or about 1 to 200 or about 200 centipoises, and more preferably exhibits melt viscosity of from 1 or about 1 to 100 or about 100 centipoises. When the releasing agent melts at less than 70° C. or about 70° C., the temperature at which the releasing agent changes is too low, and the antiblocking property may deteriorate, and image developing properties may deteriorate when the temperature in a copying machine increases. On the other hand, when the temperature exceeds 140° C. or about 140° C., the temperature at which the releasing agent changes is too high. Although fixing may be performed at a high temperature, this is not preferable in view of energy saving. Furthermore, when the melt viscosity exceeds 200 centipoises, elution from the toner is weak and the fixing releasing property may become insufficient.

The addition amount of the releasing agent to be added to the toner is from 1% or about 1% to 15% or about 15% by weight, and more preferably from about 3% to 10% by weight. When the addition amount of the releasing agent is less than 1% by weight, sufficient fixing latitude (the range of the temperature of a fixing roll or a fixing belt at which fixing may be performed without toner offset) may not be obtained, and when the addition amount of the releasing agent exceeds 15% by weight, the amount of the releasing agent released from the toner may increase and the releasing agent may more easily cause contamination of a holding member for the developing agent. Furthermore, the powder flow property of the toner may deteriorate, and the releasing agent that is released may adhere to the surface of the photoreceptor on which an electrostatic latent image is to be formed, whereby precise formation of the electrostatic latent image may be impaired.

In order to prevent adhesion of the toner to the surface of the fixing roll or fixing belt, it is necessary for the surface of the roll, for example, to be formed from a material having an excellent releasing property with respect to the toner, such as a silicone rubber or fluorine resins. In such a case, application of a minimal amount of a releasing liquid such as silicone oil to the fixing roll is effective. Although a releasing liquid is effective with respect to fixing latitude, problems exist whereby, for example, stickiness results from its transfer to the transfer material, and tape cannot be adhered to, and characters cannot be written using a permanent marker on, the material. These problems are particularly pronounced in the case of images fixed on transparent films.

The toner used for the exemplary embodiment includes known toners including at least a colorant and a binding resin.

Examples of the binding resin may include homopolymers or copolymers of styrenes such as styrene and chlorostyrene, monoolefins such as ethylene, propylene, butylene and isoprene, vinyl esters such as vinyl acetate, vinyl propionate, vinyl benzoate and vinyl acetate, a-methylenealiphaticmonocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, vinyl ketones such as vinyl methyl ketone, vinyl hexyl ketone and vinyl isopropenyl ketone, and the like. Specifically, examples of typical binding resins may include polystyrene, styrene-alkyl acrylate copolymers, styrene-alkyl methacrylate copolymers, styrene-acrylonitrile copolymer, styrene-butadiene copolymer, styrene-maleic anhydride copolymer, polyethylene and polypropylene. In addition, polyesters, polyurethanes, epoxy resins, silicon resins, polyamides, modified rosins, paraffins and waxes may be exemplified. Among these, it is specifically effective to use polyesters for the binding resin.

The polyester resin is synthesized by polycondensation of a polyol component and a polycarboxylic acid component. In the invention, either commercially available polyester resins or suitably synthesized polyester resins may be used as the above-mentioned polyester resin.

Examples of the polyvalent carboxylic acid component include, but are not limited to, aliphatic dicarboxylic acids such as oxalic acid, succinic acid, glutalic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids such as phthalic acid, isophthalic acid, terephthalic acid, naphthalene-2,6-dicarboxylic acid, malonic acid and mesaconic acid; and the like, as well as anhydrides thereof and lower alkyl esters thereof.

Examples of the tri- or more valent carboxylic acid include, for example, 1,2,4-benzenetricarboxylic acid, 1,2,5-benzenetricarboxylic acid, 1,2,4-naphthalenetricarboxylic acid, anhydrides thereof, and lower alkyl esters thereof. These may be used solely or as a combination of two or more kinds.

Furthermore, it is more preferable to include, besides the above-mentioned aliphatic dicarboxylic acid or aromatic dicarboxylic acid, a dicarboxylic acid component having a double bond. In order to prevent hot offset during fixing, the dicarboxylic acid having a double bond may be preferably used since it may form a radically crosslinked bond via the double bond. Examples of such dicarboxylic acid include, but are not limited to, maleic acid, fumaric acid, 3-hexenedioic acid, 3-octenedioic acid, and the like, lower esters thereof and acid anhydrides thereof and the like. Among these, fumaric acid, maleic acid, and the like are preferable in view of costs.

Examples of the multivalent alcohol component include divalent multivalent alcohols such as alkylene (having 2 to 4 carbon atoms) oxide adducts of bisphenol A (average addition mol number of from 1.5 to 6) such as polyoxypropylene(2.2)-2,2-bis(4-hydroxyphenyl)propane and polyoxyethylene (2.2)-2,2-bis(4-hydroxyphenyl)propane; ethylene glycol; propylene glycol; neopentylglycol; 1,4-butanediol; 1,3-butanediol; and 1,6-hexanediol.

Examples of the tri- or more valent multivalent alcohol include sorbitol, pentaerythritol, glycerol, trimethylol propane, and the like.

For the amorphous polyester resins, among the above-mentioned raw material monomers, di- or more valent secondary alcohols and/or di- or more valent aromatic carboxylic acid compounds are preferable. Examples of the di- or more valent secondary alcohol include propylene oxide adduct of bisphenol A, propylene glycol, 1,3-butanediol, glycerol, and the like, and among these, propylene oxide adduct of bisphenol A is preferable. Preferable examples of the di- or more valent aromatic carboxylic acid compound include terephthalic acid, isophthalic acid, phthalic acid and trimellitic acid, and terephthalic acid and trimellitic acid are more preferable.

Specifically, a resin having a softening point of from 90° C. or about 90° C. to 150° C. or about 150° C., a glass transition temperature of from 55° C. or about 55° C. to 75° C. or about 75° C., a number average molecular weight of from 2000 or about 2000 to 10000 or about 10000, a weight average molecular weight of from 8000 or about 8000 to 150000 or about 150000 and an acid value of from 5 mg KOH/g or about 5 mg KOH/g to 30 mg KOH/g or about 30 mg KOH/g is preferably used.

Furthermore, it is preferable to use a crystalline polyester resin as a part of the binding resin in order to impart the toner with low temperature fixing property.

The crystalline polyester resin is preferably constituted by an aliphatic dicarboxylic acid and an aliphatic diol, more preferably constituted by a linear dicarboxylic acid and a linear aliphatic diol each independently having from 4 to 20 carbon atoms in the main chain part. Where a branched chain types are used, the crystallinity and melting temperature of the polyester resin are decreased, whereby the toner blocking resistance, image storage stability and low temperature fixing property may be deteriorated. Furthermore, where the number of carbon atom is less than 4, the electric resistance is decreased due to high concentration of ester bond groups, which adversely affects the toner charging property, whereas where the number of carbon atom exceeds 20, practically-used materials are difficult to obtain. The number of carbon atom is more preferably 14 or less.

Examples of the aliphatic dicarboxylic acid that is preferably used for the synthesis of the crystalline polyester include, but are not limited to, oxalic acid, malonic acid, succinic acid, glutalic acid, adipic acid, pimeric acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and the like, and lower alkyl esters thereof and acid anhydrides thereof. Among these, sebacic acid and 1,10-decanedicarboxylic acid are preferable in view of easiness of availability.

Specific examples of the aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, and the like. Among these, 1,8-octanediol, 1,9-nonanediol and 1,10-decanediol are preferable in view of easiness of availability.

Examples of the tri- or more valent alcohol include, for example, glycerin, trimethylolethane, trimethylolpropane, pentaerythritol, and the like. These may be used solely or as a combination of two or more kinds.

In the multivalent carboxylic acid component, the content of the aliphatic dicarboxylic acid is preferably 80 mol % or more, more preferably 90 mol % or more. Where the content of the aliphatic dicarboxylic acid is less than 80 mol %, crystallinity is lowered and melting temperature of the polyester resin is decreased, whereby the toner blocking resistance, image storage stability and low temperature fixing property may be deteriorated. In the multivalent alcohol component, the content of the aliphatic diol component is preferably 80 mol % or more, more preferably 90 mol % or more. Where the content of the aliphatic diol component is less than 80 mol %, the crystallinity is lowered and melting temperature of the polyester resin is decreased, whereby the toner blocking resistance, image storage stability and low temperature fixing property may be deteriorated.

Where necessary, a monovalent acid such as acetic acid and benzoic acid, or a monovalent alcohol such as cyclohexanol and benzyl alcohol may be used in order to adjust the acid value and hydroxyl group value.

The production method of the polyester resin is not limited, and the polyester may be produced by a common polyester polymerization method including reacting an acid component and an alcohol component, such as direct polycondensation and transesterification. The production method is chosen according to the kind of monomers.

The polyester resin may be produced by subjecting the above-mentioned multivalent alcohol and multivalent carboxylic acid with condensation reaction according to a conventional method. For example, the polyester resin may be produced by charging the above-mentioned multivalent alcohol and multivalent carboxylic acid, and a catalyst where necessary, into a reaction vessel equipped with a thermometer, a stirrer and a falling condenser, heating the mixture at from 150° C. to 250° C. under inactive gas (nitrogen gas or the like), continuously removing the by-products (low molecular weight compounds) outside of the reaction system, quenching reaction at the timepoint where the acid value reaches a predetermined value, cooling, and collecting the objective reaction product.

The releasing agent may be obtained from the following waxes such as paraffin waxes and derivatives thereof, montan waxes and derivatives thereof, microcrystalline waxes and derivatives thereof, Fischer-Tropsch wax and derivatives thereof, and polyolefin waxes and derivatives thereof. Examples of the derivative include oxides, polymers with vinyl monomers, graft modified products, and the like. In addition, alcohols, aliphatic acids, vegetable waxes, animal waxes, mineral waxes, ester waxes, acid amides, and the like may be used.

Typical examples of the colorant for the toner particles may include carbon black, Nigrosine, aniline blue, carcoyl blue, chromium yellow, ultramarine blue, Du pont oil red, quinoline yellow, methyleneblue chloride, phthalocyanine blue, malachite green oxalate, lamp black, rose bengal, C. I. Pigment red 48:1, C. I. Pigment red 122, C. I. Pigment red 57:1, C. I. Pigment red 238, C. I. Pigment yellow 97, C. I. Pigment yellow 12, C. I. Pigment yellow 180, C. I. Pigment blue 15:1, C. I. Pigment blue 15:3, and the like.

The toner may includes one or more charge controlling agents for adjusting charge as an internal additive besides the binding resin, the colorant such as carbon black, and the releasing agent. Furthermore, a petrolatum resin may be incorporated in order to satisfy the milling property and heat preserving property of the toner. The petroratum resin is synthesized by using diolefins and monoolefins as raw materials, which are included in decomposed oil distillate that is produced as a by-product from an ethylene plant for producing ethylene, propylene, and the like, by steam cracking of petrolatums.

Examples of the method of producing the toner used in the exemplary embodiment include dry production methods such as knead milling, and wet production methods such as suspension polymerization and emulsion-coagulation. Among these, emulsion-coagulation is preferable since this method enables ammonia to be distributed relatively evenly throughout the toner.

Emulsion-coagulation is a method for obtaining toner particles by preparing a resin dispersion liquid by emulsion polymerization or emulsification and also preparing a colorant dispersion liquid by dispersing a colorant in a solvent and a releasing agent dispersion liquid by dispersing a releasing agent in a solvent, mixing these dispersion liquids to form aggregated particles having a toner particle size, and fusing by heating to give toner particles.

A preferable method for preparing the toner for the invention is further explained in detail.

Production Method of Toner

The production method of the toner used for the invention, which includes the above-mentioned steps of aggregation, adhesion and fusion, is explained in detail with referring to each step.

Aggregation Step

In the aggregation step, a mixed dispersion liquid is initially prepared by mixing a dispersion liquid of a first binding resin, a dispersion liquid of the colorant, and where necessary, a dispersion liquid of the releasing agent and other components, adding an aggregating agent to the mixture, and heating the mixture at a temperature slightly lower than the melting temperature of the first binding resin to form aggregated particles (core aggregated particles) in which particles including various components have been aggregated. Alternatively, fused particles (core fused particles) may be formed by performing aggregation and fusion at the same time by heating the mixture at more than glass transition temperature of the first binding resin.

The aggregated particles are formed by adding an aggregating agent under stirring in a revolution shear-type homogenizer at room temperature. As the aggregating agent used for the aggregation step, a surfactant having a reverse polarity to that of the surfactants used as a dispersing agent for various dispersion liquids, an inorganic metal salt, a di- or more valent metal complex may be preferably used.

Specifically, it is specifically preferable to use a metal complex since the amount of the surfactant to be used may be decreased and the charge property may be improved.

Examples of the inorganic metal salt include metal salts such as calcium chloride, calcium nitrate, barium chloride, magnesium chloride, zinc chloride, aluminum chloride and aluminum sulfate; inorganic metal salt polymers such as polyaluminum chloride, polyaluminum hydroxide and calcium polysulfate; and the like. Among these, aluminum salts and polymers thereof are specifically preferable. In order to obtain a still sharp particle size distribution, divalent is better than monovalent, trivalent is better than divalent, tetravalent is better than trivalent for the valency of the inorganic metal salt. Furthermore, among the inorganic metal salts having the same valency, the polymer-type inorganic metal salt polymers obtained by polymerization are more suitable than the inorganic metal salts that are not polymer-type.

Adhesion Step

In the adhesion step, a coating layer is formed by adhering resin particles formed from a second binder resin to the surface of the core particles (core aggregated particles or core fused particles) containing the first binding resin that are formed in the above-mentioned aggregation step (hereinafter, the aggregated particles having coating layers on the surfaces of the core particles are referred to as "adhered resin-aggregated particles"). Here, the coating layer corresponds to the shell layer of the toner used in the invention that is formed by the fusing step described below.

The coating layer may be formed by adding a dispersion liquid of the second resin particles to the dispersion liquid in which the core particles have been formed in the aggregation step. Where necessary, other components may be added at the same time.

The adhered resin-aggregated particles are evenly adhered to the surfaces of the core particles to form coating layers, and fused by heating in the following fusing step, whereby the resin particles formed from the second binder resin included in the coating layers of the surfaces of the core particles are melted to form shell layers. Accordingly, exposure on the surface of the toner of components such as the releasing agent included in the core layers disposed at an inner side of the shell layers may be effectively prevented.

The method for addition and mixing of the dispersion liquid of the second resin particles in the adhesion step is not specifically limited, and may be performed, for example, in a gradual and continuous manner or in a number of stages. By such addition and mixing of the dispersion liquid of the second resin particles, generation of microparticles may be suppressed and the particle size distribution of the obtained toner may be sharpened.

In the present exemplary embodiment, the adhesion step may be performed once or plural times. In the former case, only one layer including the second binder resin as a main component is formed on the surface of the core aggregated particle. However, in the latter case, plural layers respectively including a specific component as a main component may be layered on the surface of the core aggregate particle by using plural dispersion liquids including, for example, a releasing agent and particles of other components in addition to the dispersion liquid of the second resin particles.

The latter case is advantageous in that a toner having a complex and fine gradation structure may be obtained and that desired functions may be imparted to the toner. Where the adhesion step is performed plural times or performed in multiple steps, the composition from the surface to the interior portion and the physical property of the obtained toner may be varied gradually, whereby the structure of the toner may be readily controlled. Since plural layers are gradually laminated on the surface of the core particle in this case, variation of the structure and gradient of the composition may be provided from the inside to the outside of the particles in the toner, whereby physical property may be changed. Furthermore, in this case, the shell layer corresponds to all layers laminated on the surface of the core particle, and the outermost layer is constituted by the layer including the second binding resin as a main component. In the following, explanation is made on the assumption that the adhesion step is performed only once.

The condition for adhering the resin particles formed from a second binding resin to the core particles is as follows. Namely, the heating temperature in the adhesion step is preferably at a temperature around the melting temperature of the first binding resin included in the core aggregated particles, specifically preferably at the temperature in the range of the melting temperature plus or minus 10° C.

Where heating is performed at the temperature exceeding 10° C. lower than the melting temperature of the first binding resin, the resin particles formed from a first binding resin existing on the surfaces of the core particles become difficult to adhere on the resin particles formed from a second binding resin adhered on the surfaces of the core aggregate particles, whereby the thickness of the shell layer formed may become uneven.

On the other hand, where heating is performed at the temperature exceeding 10° C. higher than the melting temperature of the first binding resin, the resin particles formed from a first binding resin present on the surfaces of the core particles become easy to adhere to the resin particles formed from a second binding resin adhered on the surfaces of the core particles.

However, the particle size and particle size distribution of the obtained toner become uneven since the adhesion force becomes too strong and the particles of the adhered resin-aggregated particles are also adhered to each other. Although the heating time in the adhesion step may not be flatly defined since it depends on the heating temperature, it is generally from about 5 minutes to 2 hours. In the adhesion step, the dispersion liquid obtained by adding the dispersion liquid of the second resin particles to the mixed dispersion liquid in which the core particles have been formed may be stood still or gently stirred by a mixer or the like. The latter case is advantageous in view of easy formation of even adhered resin-aggregated particles.

Fusing Step

In the fusing step, the adhered resin-aggregated particles obtained in the adhesion step are fused by heating. The fusing step may be performed at the temperature higher than the glass transition temperature of the first binding resin or of the second binding resin, whichever is higher. When the heating temperature is high, short time is sufficient for fusing, whereas long time is required when the heating temperature is low. Namely, the time for fusing may not be flatly defined since it depends on the heating temperature, but is generally from 30 minutes to 10 hours.

Where the core particles are core fused particles, the resin particles formed from a second binding resin may be adhered to the particles. In this case, the dispersion liquid including the core fused particles is first filtered, the water ratio of the dispersion liquid is adjusted to from 30% by weight to 50% by weight, and the dispersion liquid of the second resin particles is added, whereby the particles formed from a second binding resin are adhered on the surface of the core fused particles.

Where the water ratio of the dispersion liquid is less than 30% by weight, the adhesion property of the particles formed from a second binding resin is deteriorated and the particles may be released from the core fused particles. Where the water ratio exceeds 50% by weight, stirring is difficult and the particles formed from a second binding resin may not be evenly adhered on the surfaces of the core fused particles.

The particles formed from a second binding resin adhered to the surfaces of the core fused particles may be fused by applying mechanical stress using a Henschel mixer or the like to the adhered resin-aggregated particles that are obtained by adhering the particles formed from a second binding resin to the surfaces of the core fused particles, after completion of washing/drying step mentioned below. In this way, the fusing step may be performed by applying mechanical stress instead of heating in the liquid phase.

Washing/Drying Step

The fused particles obtained by the fusing step are subjected to solid-liquid separation such as filtration, washing and drying. In this way, a toner containing no external additives is obtained.

Although the solid-liquid separation is not specifically limited, it is preferable to perform the separation by aspiration filtration, pressure filtration, or the like, in view of producibility. It is preferable to perform sufficient substitution washing with ion exchanged water in the washing in view of charging property. The drying step may be performed by any method such as general oscillation-type fluidizing drying method, spray drying method, freeze drying method and flash-jet method. It is preferable that the moisture ratio of the particles in the toner after drying is adjusted to preferably 1.0% by weight or less, more preferably 0.5% by weight or less.

The dispersion liquid of the binding resin may be prepared by any known emulsification methods. Among them, phase transition emulsification method is effective since a sharp particle size distribution is obtained and the volume average particle size is readily adjusted to the range of from 0.08 nm to 0.40 nm.

In the phase transition emulsification method, a resin is dissolved in an organic solvent that dissolves resins and a single or mixed solvent of amphoteric organic solvents to form an oil phase. A small amount of basic compound is added dropwise to the oil phase while the oil phase is stirring, and water is further added dropwise in small portions while the oil phase is stirring, whereby water drops are taken into the oil phase. When the amount of the dropped water exceeds a certain amount, the oil phase and water phase are inverted and the oil phase turns into oil drops. A step for removing the solvents is then performed by reducing the pressure to give an aqueous dispersion liquid.

The amphoteric organic solvent refers to a solvent having a solubility in water at 20° C. of at least 5 g/L or more, preferably 10 g/L or more. When the solubility is less than 5 g/L, there are problems that the effect for accelerating the treatment for making aqueous is poor and that the aqueous dispersion obtained has a poor storage stability. Examples of the organic solvent may include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones such as methyl ethyl ketone, methyl isobutyl ketone, ethyl butyl ketone, cyclohexanone and isophorone; ethers such as tetrahydrofuran and dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate and dipropylene glycol monobutyl ether, as well as 3-methoxy-3-methylbutanol, 3-methoxybutanol, acetonitrile, dimethylformamide, dimethylacetamide, diacetone alcohol, ethyl acetoacetate, and the like. These solvents may be used solely or as a mixture of two or more kinds.

The basic compound is explained. The polyester resin is neutralized by a basic compound when it is dispersed in an aqueous medium. In the invention, neutralization of polyester resin with carboxyl groups can be an impetus for aqueous condition, and aggregation between the panicles may be prevented by electric repelling force generated among carboxyl anions obtained. Examples of the basic compound include ammonia, organic amine compounds having a boiling temperature of 250° C. or less, and the like. Preferable examples of the organic amine compound may include triethylamine, N,N-diethylethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine, triethanolamine, morpholine, N-methylmorpholine, N-ethylmorpholine, and the like. It is preferable that the basic compound is added by an amount that may neutralize at least a part of carboxyl groups in the polyester resin, that is, by from 0.2 to 9.0-fold equivalent amount, and more preferably by from 0.6 to 2.0-fold equivalent amount, with respect to the carboxyl groups. Where the amount is less than 0.2-fold equivalent amount, the effect of addition of the basic compound is not observed. Where the amount exceeds 9.0-fold equivalent amount, the particle size distribution becomes broad and a fine dispersion liquid may not be obtained, which is likely due to excess increase of the hydrophilicity of the oil phase.

In the toner used for the exemplary embodiment, it is preferable that ammonia is incorporated into the resin in the step for preparing the dispersion liquid of the binding resin in order to adjust the concentration of ammonium ion obtained by ion chromatography of the toner to 50 ppm or more and 300 ppm or less. In this step, aqueous ammonia is added dropwise to the oil phase including the resin, and water is further added dropwise while the phase is stirring, whereby the carboxyl groups on the surfaces of the resin particles having a volume average particle size of from 0.08 nm to 0.40 nm obtained in this method form a salt with ammonia and are fixed. The amount of the ammonia component to be added to the toner may be controlled by the acid value of the resin, the amount of aqueous ammonia added dropwise in this step, and the volume average particle size of the resin particles.

The dispersion liquid of the colorant is formed by dispersing at least a colorant. The colorant is dispersed by any known methods, and media type dispersing apparatuses such as a revolution shear-type homogenizer, a ball mill, a sand mill and an attritor, a high pressure counter collision dispersing apparatus, and the like are preferably used. A dispersion liquid of the colorant particles may be prepared by dispersing the colorant in an aqueous solvent using ionic surfactant having polarity and using the homogenizer as mentioned above. The colorant may be used solely by one kind or as a combination of two or more kinds. The volume average particle size (hereinafter, sometimes simply referred to as average particle size) of the colorant is generally at most 1.0 μm (i.e., 1 μm or less), preferably at most 0.5 μm (i.e., 0.5 μm or less), and more preferably from 0.01 μm to 0.5 μm.

The dispersion liquid of the releasing agent is formed by dispersing at least a releasing agent. The releasing agent is dispersed by any known methods, and media type dispersing apparatuses such as a revolution shear-type homogenizer, a ball mill, a sand mill and an attritor, a high pressure counter collision dispersing apparatus, and the like are preferably used. The dispersion liquid of the releasing agent may be prepared by dispersing the releasing agent in an aqueous solvent using ionic surfactant having polarity and using the above-mentioned homogenizer. In the invention, the releasing agent may be used solely by one kind or as a combination of two or more kinds. The average particle size of the releasing agent particles is preferably at most 1 μm (i.e., 1 μm or less), and more preferably from 0.01 μm to 1 μm.

The combination of the resin for the resin particles, colorant and releasing agent is not specifically limited and may be suitably selected according to the purpose.

In the invention, according to the purpose, other components (particles) such as internal additives, charge controlling agents, inorganic particles, organic particles, lubricating agents and polishing agents may be dispersed into at least either of the above-mentioned dispersion liquid of the binding resin, dispersion liquid of the colorant and dispersion liquid of the releasing agent. In this case, the other components (particles) may be dispersed into at least either of the above-mentioned dispersion liquid of the binding resin, dispersion liquid of the colorant and dispersion liquid of the releasing agent, or dispersed into a mixed liquid of the above-mentioned dispersion liquid of the binding resin, dispersion liquid of the colorant and dispersion liquid of the releasing agent. Examples of the dispersion medium used for the above-mentioned dispersion liquid of the binding resin, dispersion liquid of the colorant, dispersion liquid of the releasing agent and other components include aqueous media and the like. Examples of the aqueous medium include waters such as distilled water and ion exchanged water, alcohols, and the like. These may be used solely by one kind or as a combination of two or more kinds. Preferable examples of the combination include distilled water and ion exchanged water. It is advantageous to add a surfactant in view of the stability of each dispersed particle of resin particles, colorant particles and releasing agent particles in the aqueous medium, and thus of the preserving property of the dispersion liquid, as well as in view of the stability of the above-mentioned aggregated particles in the aggregation step.

Examples of the dispersing agent that is added to enhance the disperse stability of the colorant in the aqueous medium and decrease the energy of the colorant in the toner include rosin, rosin derivatives, coupling agents, polymer dispersing agents, and the like. In the exemplary embodiment, it is preferable to add and incorporate the surfactant into the aqueous medium in advance so as to improve the dispersion stability.

The volume average primary particle size of the thus-obtained particles dispersion liquid may be measured, for example, using a laser diffraction-type particle size distribution measurement device (trade name: LA-700, manufactured by Horiba Ltd.). In the measurement method, a sample in the form of a dispersion liquid is adjusted so that the solid content becomes about 2 g, and ion exchanged water is added to adjust the amount of the sample to about 40 ml. The mixture is put into a cell to a suitable concentration. After about 2 minutes, measurement is initiated at the time when the concentration in the cell becomes almost constant. The volume average primary particle sizes obtained for every channel are accumulated from the lower volume average primary particle sizes, and the size at the accumulation of 50% is determined to as a volume average primary particle size.

For the toner used in the exemplary embodiment, the colorant is selected in view of the hue angle, chroma, brightness, weather resistance, OHP permeability and dispersing property in the toner. In the invention, the amount of the colorant added to the toner is in the range of from 4 to 20 parts by weight, with respect to 100 parts by weight of the resin included in the toner. Furthermore, the releasing agent is selected in view of the fixing property, toner blocking property, toner strength, and the like. In the invention, the amount of the releasing agent added to the toner is in the range of from 2 to 20 parts by weight, with respect to 100 parts by weight of the resin included in the toner.

The volume average particle size of the toner used in the exemplary embodiment is preferably from 3 μm or about 3 μm to 9 μm or about 9 μm, more preferably from 3 μm or about 3 μm to 8 μm or about 8 μm. Where the particle size is less than 3 μm, charging property becomes insufficient and development property may be deteriorated, and where the particle size exceeds 9 μm, resolution of the image is decreased.

Furthermore, the toner used in the exemplary embodiment preferably has a volume average particle size distribution index GSDv of not more than 1.30 or about 1.30.

Where the volume distribution index GSDv exceeds 1.30, the resolution of the image may be decreased. In the exemplary embodiment, the values of the particle size and the above-mentioned volume average particle size distribution index GSDv of the toner are measured and calculated as follows. First, the particle size distribution of the toner is measured by using a measurement apparatus (trade name: COULTER MULTICIZER II, manufactured by Beckman-Coulter, Inc.), a cumulative distribution is drawn from the side of the minimum diameter for the volume of the individual toner particle against the divided particle diameter ranges (channels), and the particle size when a cumulative value of 16% is defined as the volume average particle size D16v, and the particle size when a cumulative value of 50% is defined as the volume average particle size D50v. Similarly, the particle size when a cumulative value of 84% is defined as the volume average particle size D84v. The volume average particle size distribution index (GSDv) may be calculated from these values by using an equation $(D84v/D16v)^{0.5}$.

In addition, it is preferable that the toner used in the exemplary embodiment has a shape factor SF1 (=((the absolute maximum length of the diameter of the toner)$^2$/the projection area of the toner)×(π/4)×100) in the range of from 110 to 160. It is more preferable that the shape factor SF1 is in the range of from 125 to 140. The value of the shape factor SF1 represents the roundness of the toner, and the value is 100 where the toner represents a perfect circle and increases as the shape of the toner becomes irregular. Furthermore, the values required for calculation using the shape factor SF1, i.e., the absolute maximum length of the toner diameter and the projection area of the toner, are obtained by taking an image of the toner particles enlarged by 500-fold magnification using an optical microscope (trade name: MICROPHOTO-FXA, manufactured by Nikon Corporation) and subjecting the obtained information of the image to image analysis by introducing the information into an image analysis device (e.g., trade name: LUZEX III, manufactured by Nireco Corporation) via an interface. The shape factor SF1 average value is calculated based on the data obtained by measuring 1000 toner particles that are randomly sampled.

Where the shape factor SF1 is less than 110, residual toner is generally generated in the transferring step during image formation and removal of the residual toner is necessitated, whereas the cleaning property during the cleaning of the residual toner using a blade, or the like tends to be deteriorated, which may sometimes result in image defects. On the other hand, where the shape factor SF1 exceeds 160, the toner may be broken by collision with a carrier in a developing device where the toner is used as a developing agent. As a result, fine powder may increase, whereby the surface of the photoreceptor and the like are contaminated by the releasing agent component exposed on the toner surface, which may deteriorate charging property and may cause fog due to the fine powder.

In addition, after the toner is dried in a similar manner to that of general toners, inorganic particles such as silica, alumina, titania and calcium carbonate, and resin particles such as vinyl resins, polyesters and silicones may be added, as a fluidity auxiliary agent or a cleaning auxiliary agent, to the surface of the toner used in the invention, by shearing in dry state, for the purpose of providing fluidity property or improvement of cleaning property.

Examples of the inorganic oxide particles to be added to the toner may include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like, of which silica particles and titania particles are specifically preferable. It is preferable that the surfaces of the inorganic oxide particles are subjected to hydrophobisation treatment in advance. The hydrophobisation treatment is effective for improving the powder fluidity property, environment dependency of charging, and resistance to carrier contamination of the toner.

The hydrophobisation treatment may be performed by immersing the inorganic oxide particles in an agent for hydrophobisation treatment. Examples of the agent for hydrophobisation treatment include, but are not specifically limited to, silane coupling agents, silicone oils, titanate-based coupling agents, aluminum coupling agents, and the like. These may be used solely by one kind or as a combination of two or more kinds. Among these, silane coupling agents are preferable.

Any type of chlorosilanes, alkoxysilanes, silazanes and specific silylating agents may be used as the above-mentioned silane coupling agent. Specific examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, γ-chloropropyltrimethoxysilane, and the like. Although the amount of the hydrophobisation treatment agent varies depending on the kind and the like of the inorganic oxide particles and may not be flatly defined, it is generally from about 1 to 50 parts by weight, with respect to 100 parts by weight of the inorganic oxide particles.

The toner used in the exemplary embodiment may be used as a two-component developer by mixing with a carrier. Carriers are not specifically limited to, but as the core material of the carrier may include magnetic metals such as iron, steel, nickel and cobalt, alloys of these metals and manganese, chromium, rare earths, and the like, magnetic oxides such as ferrites and magnetites, and the like. Ferrites, specifically alloys with manganese, lithium, strontium, magnesium, and the like are preferable in view of core material surface property and core material resistance.

It is preferable that the carrier used in the exemplary embodiment is constituted by coating the surface of the core material with a resin. The resin is not specifically limited and may be suitably selected according to the purpose, and examples of the resin include resins known per se, such as polyolefin resins such as polyethylene and polypropylene; polyvinyl resins and polyvinylidene resins such as polystyrene, acrylic resins, polyacrylonitrile, polyvinyl acetate, polyvinyl alcohol, polyvinyl butyral, polyvinyl chloride, polyvinyl carbazole, polyvinyl ether and polyvinylketone; vinyl chloride-vinyl acetate copolymers; styrene-acrylic acid copolymers; straight silicone resins or modified product thereof including organosiloxane bonds; fluorine resins such as polytetrafluoroethylene, polyvinyl fluoride, polyvinylidene fluoride and polychlorotrifluoroethylene; silicone resins; polyesters; polyurethanes; polycarbonates; phenol resins; amino resins such as urea-formaldehyde resins, melamine resins, benzoguanamine resins, urea resins and polyamide resins; and epoxy resins. These may be used by solely one kind, or as a combination of two or more kinds.

In the exemplary embodiment, it is preferable to use at least a fluorine resin and/or silicone resin among these resins. It is advantageous to use at least a fluorine resin and/or silicone resin as the above-mentioned resin in view of the high effect of preventing carrier contamination (impaction) by the toner or additives.

It is preferable that resin particles and/or conductive particles are dispersed in the resin of the resin film. Examples of the resin particles include thermoplastic resin particles, thermosetting resin particles, and the like. Among these, thermosetting resin particles are preferable since hardness is relatively readily increased, or resin particles of nitrogen-containing resins are preferable since negative charging property is imparted to the toner. These resin particles may be used by solely one kind or as a combination of two or more kinds. The average particle size of the resin particles is preferably from about 0.1 μm to 2 μm, more preferably from 0.2 μm to 1 μm. Where the average particle size of the resin particles is less than 0.1 μm, dispersing property of the resin particles in the film is deteriorated, and when the average particle size exceeds 2 μm, the resin particles are easy to fall from the film and may not exhibit the inherent effect.

Examples of the conductive particles include metal particles such as particles made of gold, silver or copper; semiconductive oxide particles such as particles made of carbon black, titanium oxide or zinc oxide; particles obtained by coating the surfaces of titanium oxide, zinc oxide, barium sulfate, aluminum borate, potassium titanate powder, or the like with tin oxide, carbon black, a metal, or the like. These may be used by solely one kind, or as a combination of two or more kinds. Among these, carbon black particles are preferable in view of fine production stability, costs, electroconductivity, and the like. Although the kind of the carbon black is not specifically limited, a carbon black having a DBP oil absorption value of from about 50 to 250 ml/100 g is preferable in view of excellent production stability. The amount of the resin, resin particles or conductive particles for coating the surface of the core material is generally from 0.5 to 5.0 wt %, preferably from 0.7 to 3.0 wt %.

Examples of the method for forming the film include, but are not specifically limited to, a method using a liquid for film forming including the resin particles such as crosslinkable resin particles and/or the conductive particles and the resin such as a styrene acrylic resin, a fluorine resin or a silicone resin as a matrix resin in a solvent, and the like.

Specific examples of the method include immersion method including immersing the carrier core material in the liquid for film forming, spray method including spraying the liquid for film forming on the surface of the carrier core material, kneader coater method including mixing the liquid for film forming while the carrier core material is being suspended by fluidizing air and removing the solvent, and the like. Among these, kneader coater method is preferable.

The solvent used for forming the film is not specifically limited as long as it dissolves only the above-mentioned resin serving as a matrix resin, and may be selected from known solvents of this kind, and examples thereof include aromatic hydrocarbons such as toluene and xylene, ketones such as acetone and methyl ethyl ketone, ethers such as tetrahydrofuran and dioxane, and the like. When the resin particles are dispersed in the film, the resin particles and the particles serving as a matrix resin are uniformly dispersed in the thickness direction of the film and in a tangential direction to the carrier surface. Therefore, even if the carrier is used over the long term and the film is abraded, a surface having similar properties to an unused surface may be retained, and favorable properties for imparting charge to the toner may be maintained over the long term. Furthermore, when the above-mentioned conductive particles are dispersed in the film, the conductive particles and the resin serving as a matrix resin are uniformly dispersed in the thickness direction of the film and in a tangential direction to the carrier surface. Therefore, even if the carrier is used over the long term and the film is abraded, a surface having similar properties to an unused surface may be retained, and deterioration of the carrier may be prevented over the long term. When the above-mentioned resin particles and conductive particles are dispersed in the above-mentioned film, the above-mentioned effects may be exhibited at the same time.

The electric resistance of the whole magnetic carrier formed as mentioned above in the form of a magnetic brush under an electrical field of $10^4$ V/cm is preferably from $10^8$ to $10^{13}$ Ωcm. Where the electric resistance of the magnetic carrier is less than $10^8$ Ωcm, the carrier adheres on the image portion on the latent image holding member, and brush marks are readily generated. On the other hand, where the electric resistance of the magnetic carrier exceeds $1\times10^{13}$ Ωcm, an edge effect is observed and image quality is deteriorated.

The volume resistivity value is measured as follows.

A sample is put on a lower electrode plate of a measurement jig, which is a pair of 20 $cm^2$ circular electrode plates (made of steel) connected to an electrometer (trade name: KEITHLEY 610C, manufactured by Keithley Instruments, Inc.) and a high pressure electrical source (trade name: FLUKE 415B, manufactured by Fluke Corporation), so that the sample forms a plane layer having a thickness of from about 1 mm to 3 mm. An upper electrode plate is put on the sample, and a 4 Kg weight is put on the upper electrode plate so as to remove the gaps in the sample. In this state, the thickness of the sample layer is measured. Voltage is then applied to both electrode plates to measure the value of the electrical current, and volume resistivity value is calculated based on the following equation.

$$\text{Volume resistivity value} = \text{applied voltage} \times 20/(\text{current value} - \text{initial current value})/\text{sample thickness}$$

In the above-mentioned equation, the initial current value is the value of the current when the applied voltage is 0, and the current value is the value of the measured current value.

Hereinafter, an example of the image forming apparatus of the exemplary embodiment is shown by using drawings, but the invention is not limited to the example. It is noted that only main portions of the drawings are explained and explanations of other portions are omitted.

Figure 2:
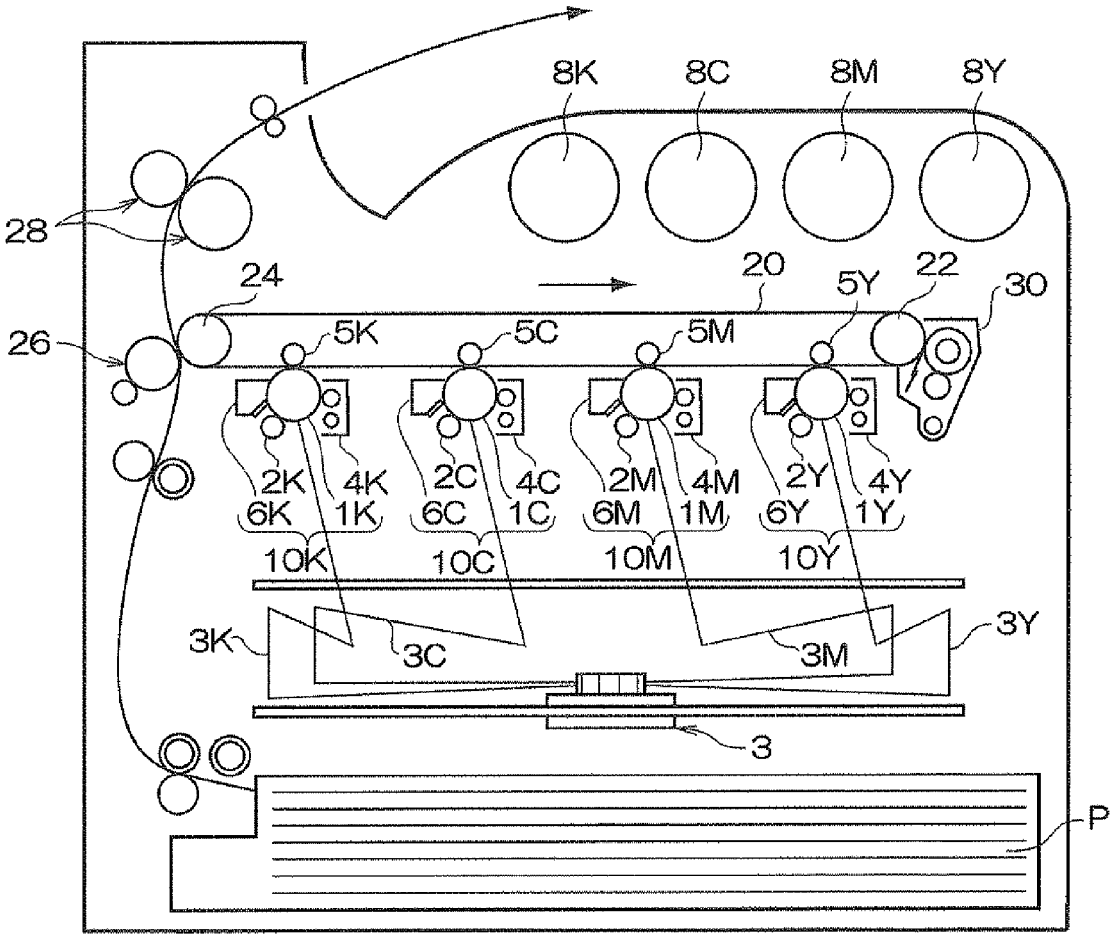
FIG. 2 is a schematic constitutional drawing showing an example of an image forming apparatus of the exemplary embodiment.

FIG. 2 is a schematic constitutional drawing showing a preferable example of the image forming apparatus of the exemplary embodiment. The image forming apparatus shown in FIG. 2 is a 4-drum tandem full-color image forming apparatus, which includes a first to fourth electrophotographic image forming units 10Y, 10M, 10C and 10K (image forming means) that output yellow (Y), magenta (M), cyan (C) and black (K) images based on color-separated image data, respectively. These image forming units (hereinafter, simply referred to as "units") 10Y, 10M, 10C and 10K are aligned in the horizontal direction at predetermined intervals. These units 10Y, 10M, 10C and 10K may be process cartridges that are removable from and attachable to the main body of the image forming apparatus.

In the upper part of the units 10Y, 10M, 10C and 10K in the drawings, an intermediate transfer belt 20 as an intermediate transfer medium is extended via each unit. The intermediate transfer belt 20 wraps around a driving roller 22 and support roller 24 that is contacted with the inner surface of the intermediate transfer belt 20, which are provided apart from each other in the direction from the left to the right of the drawing, and runs in the direction from the first unit 10Y to the fourth unit 10K. The support roller 24 is biased in the direction aparting from the driving roller 22 by a spring or the like (not shown in the drawing), and a predetermined tension is applied to the intermediate transfer belt 20 that wraps around the both rollers. An intermediate transfer medium cleaning device 30 that is opposed to the driving roller 22 is provided on the side surface of the photoreceptor of the intermediate transfer belt 20.

Toners of four colors (yellow, magenta, cyan and black) contained in toner cartridges 8Y, 8M, 8C and 8K may be supplied to each of the developing devices (developing unit) 4Y, 4M, 4C and 4K of the units 10Y, 10M, 10C and 10K.

Since the above-mentioned first to fourth units 10Y, 10M, 10C and 10K have similar constitutions, the first unit 10Y for forming yellow images set on the upperstream of the running direction of the intermediate transfer belt is explained herein as a representative. Explanations on the second to fourth units 10M, 10C and 10K are omitted herein by providing reference symbols magenta (M), cyan (C) and black (K) instead of yellow (Y) to the portions similar to that of the first unit 10Y.

The first unit 10Y includes a photoreceptor 1Y that acts as an electrostatic latent image holding member. A charging roller 2Y for charging the surface of the photoreceptor 1Y with predetermined potential, an exposing device 3 for exposing the charged surface by a laser beam 3Y based on color-separated image signal to form an electrostatic latent image, a developing device (developing unit) 4Y for developing the electrostatic latent image by supplying the charged toner to the electrostatic latent image, a first transfer roller 5Y (first transfer unit) for transferring the developed toner image on the intermediate transfer belt 20, and a photoreceptor cleaning device (cleaning unit) 6Y for removing the toner remaining on the surface of the photoreceptor 1Y after first transfer, are provided on the circumference of the photoreceptor 1Y in this order.

The first transfer roller 5Y is provided inside of the intermediate transfer belt 20 and set on the position opposing to the photoreceptor 1Y. Furthermore, bias electrical sources (not shown in the drawing) for applying a first transfer bias are each connected to the first transfer rollers 5Y, 5M, 5C and 5K. Each bias electrical source varies the transfer bias applied to each of the first transfer rollers by a control portion (not shown in the drawing).

Hereinafter, the operation for forming a yellow image in the first unit 10Y is explained. First, prior to the operation, the surface of the photoreceptor 1Y is charged with a potential of about −600 V to −800 V by the charging roller 2Y.

For the charging system used in the exemplary embodiment, conventionally known non-contact system by a corotron or a scorotron may be preferably employed. However, since the photoreceptor used in the exemplary embodiment has strong mechanical strength, specifically excellent durability is exhibited when contact charging that provides high stress to the photoreceptor is used. Furthermore, since the contact charging system is performed contacted with and adjacent to the photoreceptor, the discharge products are readily adhered on the surface of the photoreceptor while the absolute amount of the discharge products is relatively small. However, by using the toner used in the above-mentioned exemplary embodiment, the discharge products adhered on the surface of the photoreceptor may be readily removed. Furthermore, it is preferable that the photoreceptor used in the exemplary embodiment has a mechanism that may supply only a toner since the photoreceptor may be used 200000 cycles or more, further 250000 cycles, or 300000 cycles or more.

The contact charging system that is preferably used in the exemplary embodiment charges the surface of the photoreceptor by applying voltage on the conductive member contacting with the surface of the photoreceptor. The shape of the conductive member may be any of brush shape, blade shape, pin electrode shape, roller shape, and the like, and a roller-shaped member is specifically preferable. Generally, the roller-shaped member is constituted by, from the outer side, a resistance layer, and an elastic layer and a core material that support the resistance layer. Where necessary, a protective layer may be provided on the outer side of the resistance layer.

The roller-shaped member acts as a charging unit, without a specific driving unit, by revolving at a circumferential velocity similar to that of the photoreceptor when it is contacted with the photoreceptor. However, charging may be performed by attaching a certain driving unit to the roller member and revolving the roller member at a circumferential velocity different from that of the photoreceptor. Examples of the material for the core material include those having electroconductivity, and generally iron, copper, brass, stainless, aluminum, nickel, and the like are used. Furthermore, other resin formed articles in which conductive particles and the like have been dispersed, and the like may be used.

The material for the elastic layer is a conductive material or a semiconductive material, generally a dispersion of conductive particles or semiconductive particles in a rubber material. As the rubber material, EPDM, polybutadiene, natural rubber, polyisobutylene, SBR, CR, NBR, silicone rubber, urethane rubber, epichlorohydrin rubber, SBS, thermoplastic elastomers, norbornene rubber, fluorosilicone rubber, ethylene oxide rubber, and the like are used. For the conductive particles or semiconductive particles, metals such as carbon black, zinc, aluminum, copper, iron, nickel, chromium and titanium, and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO may be used, and these materials may be used solely or as a mixture of two or more kinds.

The material for the resistance layer and protective layer is obtained by dispersing the conductive particles or semiconductive particles in the binding resin to control its resistance, and the resistivity may be from $10^3$ to $10^{14}$ Ωcm, preferably from $10^5$ to $10^{12}$ Ωcm, and further preferably from $10^7$ to $10^{12}$ Ωcm. The film thickness may be from 0.01 μm to 1000 μm, preferably from 0.1 μm to 500 μm, and further preferably from 0.5 μm to 100 μm. As the binding resin, acrylic resins, cellulose resins, polyamide resins, methoxymethylated nylon, ethoxymethylated nylon, polyurethane resins, polycarbonate resins, polyester resins, polyethylene resins, polyvinyl resins, polyarylate resins, polythiophene resins, polyolefin resins such as PFA, FEP and PET, styrene butadiene resins, and the like are used. As the conductive particles or semiconductive particles, carbon black, metals and metal oxides similar to those used for the elastic layer are used. Furthermore, where necessary, an antioxidizing agent such as hindered phenol and hindered amine, a filler such as clay and kaolin, or a lubricating agent such as silicone oil may be added. As the method for forming these layers, blade coating method, Mayer bar coating method, spray coating method, immersion coating method, bead coating method, air knife coating method, curtain coating method, and the like may be used.

The method for charging the photoreceptor using these conductive members includes applying voltage on a conductive member, and the voltage to be applied is preferably direct current voltage, or alternate current voltage superimposed on direct current voltage. Where alternate current voltage is superimposed, the absolute amount of the discharge products is relatively high and the products easily adhere to the surface of the photoreceptor surface. However, it is not a problem since the discharge products adhered on the surface of the photoreceptor may be readily removed by using the toner of the invention having a predetermined amount of ammonia. The range of the direct current voltage is preferably from 50 to 2000V, specifically preferably from 100 to 1500V of positive or negative, according to the required charge potential of the photoreceptor. Where alternate current voltage is superimposed, the voltage between the peaks is from 400 to 1800 V, preferably from 800 to 1600 V, and further preferably from 1200 to 1600 V. The frequency of the alternate current voltage is from 50 to 20,000 Hz, preferably from 100 to 5,000 Hz.

The image forming method and device using the long life photoreceptor of the invention show a significant effect in the case where electrophotographic process is used 200000 cycles or more, specifically 250000 cycles or more, further 300000 cycles or more without changing the photoreceptor. The photoreceptor is effectively used in image forming apparatus in which specific image quality such as color is strictly demanded, specifically in tandem high-speed machines.

In the image forming apparatus shown in FIG. 2, the photoreceptor 1Y has the property of changing the specific resistance of the portion of the photosensitive layer onto which the laser beam 3Y is irradiated. Therefore, the laser beam 3Y is output to the surface of the charged photoreceptor 1Y via the exposure device 3 based on image data for the color yellow that is delivered from a control portion (not shown in the drawing). The laser beam 3Y is irradiated onto the photosensitive layer on the surface of the photoreceptor 1Y, whereby an electrostatic latent image having a yellow printing pattern is formed on the surface of the photoreceptor Y.

The electrostatic latent image refers to an image that is formed on the surface of the photoreceptor 1Y by charging, which is a negative latent image that is formed by decreasing the specific resistance of the part of the photosensitive layer irradiated by the laser beam 3Y and allowing the charged electrical charge to flow on the surface of the photoreceptor 1Y while leaving the electrical charge on the part on which laser beam 3Y is not irradiated.

The electrostatic latent image formed on the photoreceptor 1Y as above is rotated to a predetermined image development position in accordance with the traveling motion of the photoreceptor 1Y The electrostatic latent image on the photoreceptor 1Y is then visualized as an image (a developed image) at the image development position by the developing device 4Y.

The developing device 4Y includes, for example, a yellow toner containing a toner having a volume average particle size of 7 μm, which includes at least a yellow colorant and a binding resin. The yellow toner is stirred in the developing device 4Y so as to be charged by abrasion and held on a developing agent roll (a holding member for a developing agent), wherein the toner has an electrical charge of the same polarity (negative polarity) as that of the charge on the photoreceptor 1Y. The surface of the photoreceptor 1Y then passes the developing device 4Y, whereby the yellow toner is electrostatically adhered to the latent image portion on the surface of the photoreceptor 1Y from which electrical charge has been removed, and a latent image is developed by the yellow toner. The photoreceptor 1Y on which the yellow toner image has been formed is then made to travel at a predetermined velocity, whereby the toner image developed on the photoreceptor 1Y moves to a predetermined first transfer position.

When the yellow toner image on the photoreceptor 1Y is moved to the first transfer position, primary predetermined transfer bias is applied on the first transfer roller 5Y, the electrostatic power directed to the first transfer roller 5Y from the photoreceptor 1Y act on the toner image, and the toner image on the photoreceptor 1Y is transferred on the intermediate transfer belt 20. The transfer bias applied at this stage has positive (+) polarity that is opposite to negative (−) polarity of the toner, and for example, it is controlled to about +10 μA on the first unit 10Y by the control portion (not shown in the drawing).

On the other hand, the toner remained on the photoreceptor 1Y is removed and collected by a cleaning device 6Y.

The first transfer biases applied on the first transfer rollers 5M, 5C and 5K following a second unit 10M are also controlled in a similar manner to that of the first unit.

The intermediate transfer belt 20 on which the yellow toner image has been transferred by the first unit 10Y is carried subsequentially via the second to fourth units 10M, 10C and 10K, and the color toner images are superposed thereon to complete multiple transfer.

The intermediate transfer belt 20 on which four color toner images have been multiply transferred via the first to fourth unit is then transferred to a second transfer portion constituted by the intermediate transfer belt 20, support roller 24 that is contacted with the inner surface of the intermediate transfer belt 20, and second transfer roller (second transfer unit) 26 provided on the image holding surface of the intermediate transfer belt 20. Meanwhile, a recording paper (a body on which an image is to be transferred) P is supplied to a gap at which the second transfer roller 26 and the intermediate transfer belt 20 are mutually contacted via a supplying mechanism at a predetermined timing, whereby a predetermined second transfer bias is applied to the support roller 24. The transfer bias applied at this time has negative (−) polarity that is the same as the negative (−) polarity of the toner, and the electrostatic force directed to the recording paper P from the intermediate transfer belt 20 acts on the toner image, whereby the toner image on the intermediate transfer belt 20 is transferred on the recording paper P. The second transfer bias used at this stage is determined according to the resistance detected by a resistance detecting unit (not shown in the drawing) that detects the resistance of the second transfer portion, and is controlled by voltage.

The recording paper P is then fed to a fixing device (fixing unit) 28, the toner image is heated, and the color-superposed toner image is melted and fixed on the recording paper P. The recording paper P on which fixing of the color image has been completed is carried to an ejecting portion, whereby a series of operations for forming a color image is completed.

Although the above-mentioned image forming apparatus has a constitution in which the toner image is transferred on the recording paper P via the intermediate transfer belt 20, the invention is not limited to this constitution and may have a constitution in which the toner image is transferred on the recording paper directly from the photoreceptor.

In the image forming apparatus according to the exemplary embodiment, a cleaning blade is preferably used as a cleaning unit.

The cleaning blade is not specifically limited and any of known cleaning blades may be used, and one made of an elastomer having a JISA rubber hardness of 50° or more and 100° or less in 25° C. environment, a 300% modulus of 8 MPa or more and 55 MPa or less, and a repelling elasticity of 4% or more and 85% or less may be exemplified in view of that the cleaning property may be maintained for a long term, and the like.

The specific measurement method of the repelling elasticity is a method similar to the Lupke repelling elasticity test described in JIS K6255, "Repelling Elasticity Test Method for Vulcanized Rubber and Thermoplastic Rubber". For the measurement of repelling elasticity, it is preferable to sufficiently leave a sample to be measured under the temperature of the measurement condition (e.g., under 25° C. environment where repelling elasticity at 25° C. is measured) so that the sample has the temperature of the measurement condition upon measurement.

The material for the cleaning blade is not specifically limited, and various elastomers may be used. Examples of specific elastomer include elastomers such as polyurethane elastomers, silicone rubbers and chloroprene rubbers.

As the polyurethane elastomer, a polyurethane that is generally synthesized by addition reaction of an isocyanate, a polyol and various hydrogen-containing compounds is used. This is produced by preparing a urethane prepolymer using a polyol component including polyether polyols such as polypropylene glycol and polytetramethylene glycol, and polyester polyols such as adipate polyols, polycaprolactum polyols and polycarbonate polyols, and an isocyanate component including aromatic polyisocyanates such as trirenediisocyanate, 4,4'-diphenylmethanediisocyanate, polymethylenepolyphenylpolyisocyanate and toluidine diisocyanate, and aliphatic polyisocyanates such as hexamethylenediisocyanate, isophorone diisocyanate, xylylene diisocyanate and dicyclohexylmethanediisocyanate; adding a curing agent to the prepolymer; pouring the mixture into a predetermined mold; curing the mixture by crosslinking; and aging the product at ordinary temperature. Examples of the above-mentioned curing agent generally include combinations of a divalent alcohol such as 1,4-butanediol and a trivalent or more multivalent alcohol such as trimethylol propane and pentaerythritol.

The process cartridge of the exemplary embodiment is removable from and attachable to the main body of the image forming apparatus, and includes at least an electrophotographic photoreceptor and a developing unit for developing an electrostatic latent image formed on the electrophotographic photoreceptor by using a toner to form a toner image, wherein the electrophotographic photoreceptor has an outermost layer including a charge transporting material and at least one kind of curable resin selected from the group consisting of a phenol resin, an epoxy resin and a melamine resin, and wherein the toner has a concentration of ammonium ion determined by ion chromatography of 50 ppm or more and 300 ppm or less.

Figure 3:
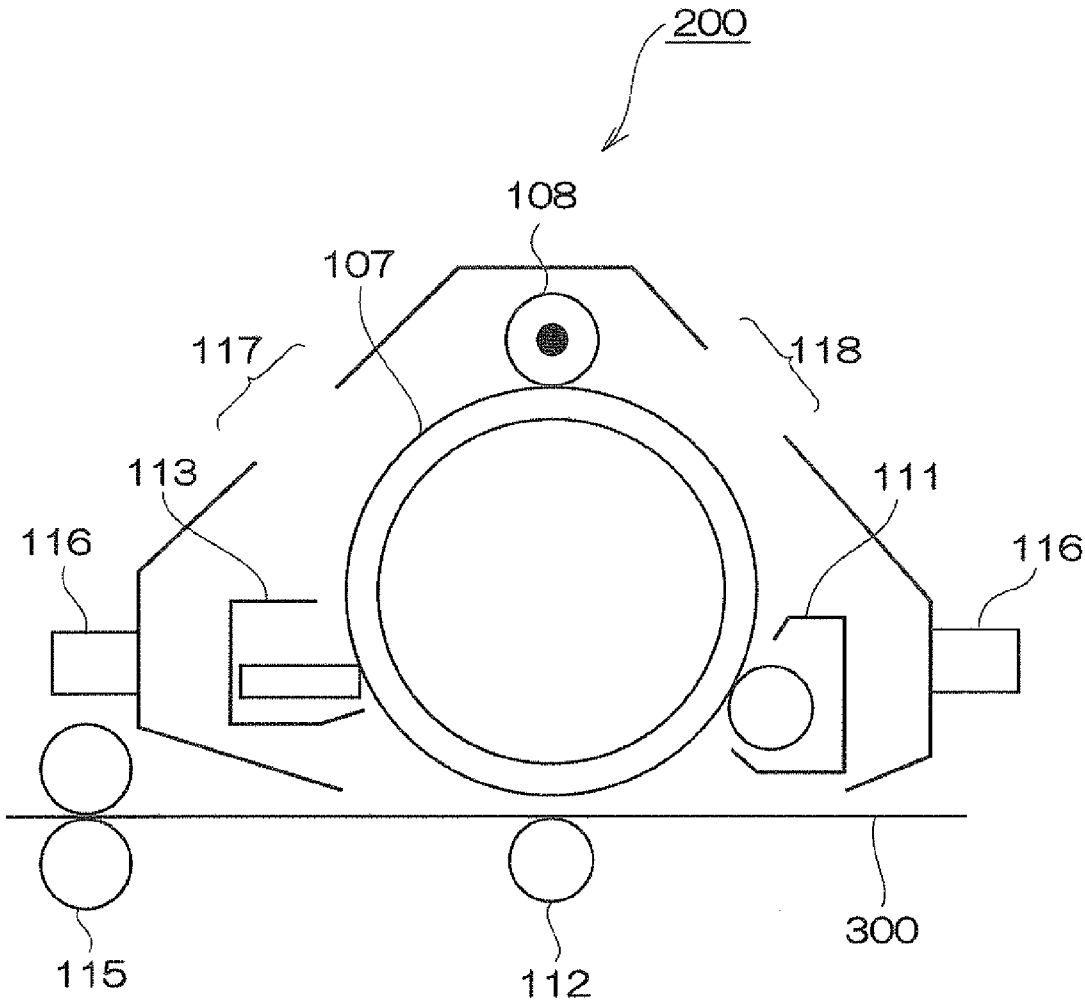
FIG. 3 is a schematic constitutional drawing showing an example of a process cartridge of the exemplary embodiment.

FIG. 3 is a schematic constitutional drawing showing a preferable example of the process cartridge of the exemplary embodiment. A process cartridge 200 includes a photoreceptor 107, a charging roller 108, a developing device 111, a photoreceptor cleaning device (cleaning unit) 113, an aperture 118 for exposing and an aperture 117 for discharging exposure, which are combined by using attachment rail 116 and integrated.

The process cartridge 200 is removable from and attachable to a transfer device 112, a fixing device 115 and other constitutional parts (not shown in the drawing), and constitutes the image forming apparatus together with the main body of the image forming apparatus. The symbol 300 represents a recording paper.

The process cartridge 200 shown in FIG. 3 includes the charging roller 108, the developing device 111, the cleaning device (cleaning unit) 113, the aperture 118 for exposing, the aperture 117 for discharging exposure, and these devices may be selectively combined. The process cartridge of the exemplary embodiment includes, besides the photoreceptor 107, at least one kind of device selected from the charging roller 108, the developing device 111, the cleaning device (cleaning unit) 113, the aperture 118 for exposing and the aperture 117 for exposing by removing electricity. The process cartridge 200 may include a vessel for containing the toner and a toner carrying device that carries the toner supplied to the developing device 111 from the vessel for containing the toner, which are not shown in the drawing.

EXAMPLES

Hereinafter the exemplary embodiment is explained with referring to the Examples, but the invention is not limited thereto. In the following Examples, "part" refers to "parts by weight" unless specifically mentioned. The physical property values are measured as follows.

[Measurement of Tg of the Binding Resin]

Using a differential scanning calorimeter (trade name: DSC3110, thermal analysis system 001, manufactured by MacScience, hereinafter, abbreviated as "DSC"), the temperature is raised from 0 to 150° C. at 10° C./min, hold at 150° C. for 5 minutes, decreased from 150° C. to 0° C. at −10° C./min using liquid nitrogen, hold at 0° C. for 5 minutes, and raised again from 0° C. to 150° C. at 10° C./min. The onset temperature obtained by analyzing the endothermic curve at the second temperature raising is determined to be Tg.

[Measurement of Acid Value of Resin]

Measurement is performed according to JIS-K0070:92 using an acetone-toluene mixed solution by potential differential titration method.

[Measurement of Concentration of Ammonium Ion in Toner]

Quantitative estimation of the amount of the ammonium in the toner is performed as follows. 1 part of 10% by weight of nonionic surfactant is added to 0.5 part of toner, and ultrapure water is further added so that the total amount becomes 100 parts. The toner is dispersed again and extracted by ultrasonic shaking in a thermostatic chamber controlled at 30° C. plus or minus 1° C. for 30 minutes. Apart of the toner dispersion liquid is then filtered, and the amount of ammonium ion in the filtrate is subjected to quantitative estimation using ion chromatography.

<Preparation of Electrophotographic Photoreceptor>

(Preparation of Base Photoreceptor)

100 parts of zinc oxide (average particle size 70 nm, a trial product manufactured by Teika Corporation) is mixed with 500 parts of toluene under stirring. 1.5 parts of silane coupling agent (trade name: KBM603, manufactured by Shin-Etsu Chemical Co., Ltd.,) is added thereto and the mixture is stirring for 2 hours. Toluene is then distilled off by distillation under reduced pressure, and the residue is baked at 150° C. for 2 hours.

The above-mentioned surface-treated 60 parts of zinc oxide, 15 parts of curing agent (a blocked isocyanate, trade name: SUMIDULE 3175, manufactured by Sumitomo Bayer Urethane Company Ltd.), and 15 parts of butyral resin (trade names BM-1, manufactured by Sekisui Chemical Co, Ltd.,) are dissolved in 85 parts of methyl ethyl ketone to give a solution. 38 parts of this solution is mixed with 25 parts of methyl ethyl ketone and dispersed in a sand mill using glass beads of 1 mmϕ for 2 hours to give a dispersion liquid for an undercoating layer. 0.005 part of dioctyl tin dilaurate is added as a catalyst to the obtained dispersion liquid to give a coating solution for an undercoating layer. The coating solution is applied on an aluminum substrate having a diameter of 30 mm and a thickness of 1 mm by immersion application method and cured by drying at 160° C. for 100 minutes to give an undercoating layer having a thickness of 1.5 μm.

Next, a mixture of 15 parts of hydroxygallium phthalocyanine as an electrical charge generating material, 10 parts of vinyl chloride-vinyl acetate copolymer resin (trade name: VMCH, manufactured by Nippon Unicar Company Limited) and 300 parts of n-butyl alcohol is dispersed in a sand mill for 4 hours. The obtained dispersion liquid is immersion-applied on the above-mentioned undercoating layer, and dried at 100° C. for 10 minutes to form a charge generating layer having a film thickness of 0.4 μm.

Next, 40 parts of N,N'-bis(3-methylphenyl)-N,N'-diphenylbendizine and 60 parts of bisphenol Z polycarbonate resin (molecular weight: 40,000) are sufficiently dissolved and mixed in 280 parts of tetrahydrofuran and 120 parts of toluene to give a coating solution for a charge transporting layer. The coating solution is immersion-applied on the aluminum support on which the charge generating layer has been applied, and dried at 100° C. for 40 minutes to form a charge transporting layer having a film thickness of 25 μm.

The above-mentioned photoreceptor obtained by forming the undercoating layer, charge generating layer and charge transporting layer on the aluminum substrate is referred to as "base photoreceptor".

<Preparation of Coating Solution for Forming Protective Layer>

(Coating Solution for Forming Protective Layer-1)

10 parts of charge transporting material represented by the following compound (I-1), 7 parts of phenol resin (trade name: PL-2215, manufactured by Gunei Chemical Industry Co., Ltd.,) and 1.5 parts of 2,5-dimethyl-3-hexine-2,5-diol (manufactured by Tokyo Chemical Industry Co., Ltd.,) are mixed and dissolved in 27 parts of butyl alcohol to give a coating solution for forming a protective layer. The coating solution is referred to as "coating solution for forming protective layer-1".

(I-1)

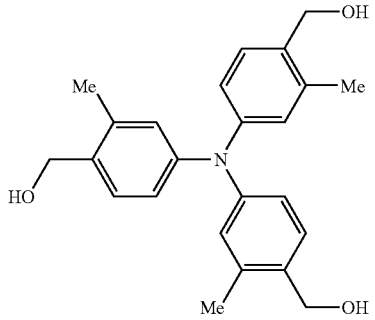

(Photoreceptor 1)

The coating solution for forming protective layer-1 obtained as above is applied on the charge transporting layer of the base photoreceptor prepared as above, by ring-type immersion application method. The applied film is then air dried at room temperature for 30 minutes and cured by heat treatment at 150° C. for 50 minutes to form a protective layer having a film thickness of about 5 μm to give a photoreceptor 1.

(Photoreceptor 2)

The coating solution for forming protective layer-1 obtained as above is applied on the charge transporting layer of the base photoreceptor prepared as above, by ring-type immersion application method. The applied film is then air dried at room temperature for 10 minutes and cured by heat treatment at 150° C. for 60 minutes to form a protective layer having a film thickness of about 3 μm to give a photoreceptor 2.

(Photoreceptor 3)

The coating solution for forming protective layer-1 prepared as above is applied on the charge transporting layer of the base photoreceptor prepared as above, by ring-type immersion application method. The applied film is then air dried at room temperature for 10 minutes and cured by heat treatment at 150° C. for 50 minutes to form a protective layer having a film thickness of about 7 μm to give a photoreceptor 3.

<Preparation of Toner>

Synthesis of Crystalline Polyester Resin (1)

100 mol % of decanedicarboxylic acid, 100 mol % of nonanediol and 0.3% by weight of dibutyltin oxide as a catalyst with respect to the total weight of these monomers are put into a heat-dried three-necked flask. The air in the vessel is substituted with nitrogen gas under reduced pressure to make inactive atmosphere, and the mixture is stirred by a mechanical stirrer under reflax at 180° C. for 5 hours.

The temperature is then gradually raised up to 230° C. under reduced pressure, the mixture is stirred for 2 hour, and when the mixture becomes viscous, the mixture is cooled in the air to quench the reaction to synthesize a crystalline polyester resin (1). The weight average molecular weight (Mw) of the obtained crystalline polyester resin (1) is 22000 and the number average molecular weight (Mn) is 7300 by molecular weight measurement (polystyrene conversion) using gel permeation chromatography. The acid value is 10.6 mg KOH/g.

The melting temperature (Tm) of the crystalline polyester resin (1) is measured according to the above-mentioned measurement method by differential scanning calorimetry (DSC). A clear endothermic peak is observed and the endothermic peak temperature is 72.2° C.

Synthesis of Amorphous Polyester Resin (1)

Bisphenol A ethylene oxide 2 mol adduct: 10 mol %
Bisphenol A propylene oxide adduct: 90 mol %
Terephthalic acid: 40 mol %
Fumaric acid: 40 mol %
Dodecenyl succinate: 20 mol %

The above-mentioned monomers are charged into a flask (5 L volume) equipped with a stirrer, a nitrogen induction tube, a temperature sensor and a rectification tower. The temperature is raised to 190° C. over 1 hour, even stirring in the reaction system is confirmed, and 0.8% by weight of tin distearate (with respect to total weight of these monomers) is added. The temperature is raised from the same temperature to 240° C. over 6 hours while the water produced is distilled off. The dehydration condensation reaction is continued at 240° C. for additional 3 hours to give an amorphous polyester resin (1) having a glass transition temperature of 60° C., an acid value of 13.6 mg KOH/g, a weight average molecular weight of 18000, and a number average molecular weight of 6100.

Synthesis of Amorphous Polyester Resin (2)

Bisphenol A ethylene oxide 2 mol adduct: 50 mol %
Bisphenol A propylene oxide adduct: 50 mol %
Trimeritic anhydride: 7 mol %
Terephthalic acid: 65 mol %
Dodecenyl succinate: 28 mol %

Using the monomers except for trimellitic anhydride, a reaction is performed according to the same method as that for the amorphous polyester resin (1) until the softening point becomes 110° C. The temperature is then decreased to 190° C., 7 mol % of trimellitic anhydride is gradually added, and the mixture is reacted at the same temperature for 1 hour to give an amorphous polyester resin (2) having a glass transition temperature of 56° C., an acid value of 11.8 mg KOH/g, a weight average molecular weight of 78000 and a number average molecular weight of 7400.

Preparation of Resin Particle Dispersion Liquid (1)

Crystalline polyester resin (1): 100 parts
Methyl ethyl ketone: 60 parts
Isopropyl alcohol: 15 parts Methyl ethyl ketone is put into a 5 L separable flask, and the above-mentioned resin is gradually added thereto. The mixture is stirred by a three-one motor to achieve complete dissolution to give an oil phase. The 5 L separable flask containing this oil phase is set at 65° C. in a water bathe and 10% ammonia aqueous solution (total 1.5 parts) is gradually added dropwise using a dropper while the oil phase is stirred. Furthermore, 230 parts of ion exchanged water is gradually added dropwise at the velocity of 10 ml/min to perform phase transition emulsification, and the solvent is removed using an evaporator under reduced pressure to give resin particle dispersion liquid (1) formed from the crystalline polyester resin (1). The volume average particle size of the resin particles is 150 nm (the solid content of the resin particles is adjusted to 20% by adding ion exchanged water).

Preparation of Resin Particle Dispersion Liquid (2)

Amorphous polyester resin (1): 100 parts
Methyl ethyl ketone: 60 parts
Isopropylalcohol: 15 parts Methyl ethyl ketone is put into a 5 L separable flask, and the above-mentioned resin is gradually added thereto. The mixture is stirred by a three-one motor to achieve complete dissolution to give an oil phase. The 5 L separable flask containing this oil phase is set at 40° C. in a water bath, and 10% ammonia aqueous solution (total 1.5 parts) is gradually added dropwise using a dropper while the oil phase is stirred. Furthermore, 230 parts of ion exchanged water is gradually added dropwise at the velocity of 10 ml/min to perform phase transition emulsification, and the solvent is removed using an evaporator under reduced pressure to give resin particle dispersion liquid (2) formed from the amorphous polyester resin (1). The volume average particle size of the resin particles is 120 nm (the solid content of the resin particles is adjusted to 20% by adding ion exchanged water).

Preparation of Resin Particle Dispersion Liquid (3)

Resin particle dispersion liquid (3) is obtained according to a similar manner to the preparation of the resin particle dispersion liquid (1) except that the amount of 10% ammonia aqueous solution is changed from 1.5 parts to 2.5 parts. The volume average particle size of the resin particles is 151 nm (the solid content of the resin particles is adjusted to 20% by adding ion exchanged water).

Preparation of Resin Particle Dispersion Liquid (4)

Resin particle dispersion liquid (4) is obtained according to a similar manner to the preparation of the resin particle dispersion liquid (1) except that the amount of 10% ammonia aqueous solution is changed from 1.5 parts to 3.5 parts. The volume average particle size of the resin particles is 173 nm (the solid content of the resin particles is adjusted to 20% by adding ion exchanged water).

Preparation of Resin Particle Dispersion Liquid (5)

Resin particle dispersion liquid (5) is obtained according to a similar manner to the preparation of the resin particle dispersion liquid (1) except that the amount of 10% ammonia aqueous solution is changed from 1.5 parts to 5.0 parts. The volume average particle size of the resin particles is 178 nm (the solid content of the resin particles is adjusted to 20% by adding ion exchanged water).

Preparation of Resin Particle Dispersion Liquid (6)

Resin particle dispersion liquid (6) is obtained according to a similar manner to the preparation of the resin particle dispersion liquid (2) except that the amorphous polyester resin (1) is substituted with the amorphous polyester resin (2). The volume average particle size of the resin particles is 146 nm (the solid content of the resin particles is adjusted to 20% by adding ion exchanged water).

Preparation of Resin Particle Dispersion Liquid (7)

Resin particle dispersion liquid (7) is obtained according to a similar manner to the preparation of the resin particle dispersion liquid (6) except that the amount of 10% ammonia aqueous solution is changed from 1.5 parts to 2.5 parts. The volume average particle size of the resin particles is 187 nm (the solid content of the resin particles is adjusted to 20% by adding ion exchanged water).

Preparation of Resin Particle Dispersion Liquid (8)

Resin particle dispersion liquid (8) is obtained according to a similar manner to the preparation of the resin particle dispersion liquid (6) except that the amount of 10% ammonia aqueous solution is changed from 1.5 parts to 3.5 parts. The volume average particle size of the resin particles is 208 nm (the solid content of the resin particles is adjusted to 20% by adding ion exchanged water).

Preparation of Resin Particle Dispersion Liquid (9)

Resin particle dispersion liquid (9) is obtained according to a similar manner to the preparation of the resin particle dispersion liquid (6) except that the amount of 10% ammonia aqueous solution is changed from 1.5 parts to 5.0 parts. The volume average particle size of the resin particles is 212 nm (the solid content of the resin particles is adjusted to 20% by adding ion exchanged water).

Preparation of Colorant Particle Dispersion Liquid 1

Blue pigment (copper phthalocyanine B15:3, manufactured by Dainichiseika Color & Chemicals Mfg. Co., Ltd.): 50 parts Ionic surfactant (trade name: NEOGEN RK, manufactured by Daiichi Kogyo Seiyaku Co., Ltd.); 5 parts Ion exchanged water: 195 parts The above-mentioned components are mixed and dispersed in a homogenizer (trade name: ULTRATURRAX, manufactured by IKA) for 10 minutes. The dispersion is dispersed using a cross-collision type wet-type pulverizer (trade name: ULTIMIZER, manufactured by Sugino Machine Ltd.) under a pressure of 245 Mpa for 15 minutes to give colorant particle dispersion liquid 1 having a center particle size of the colorant particles of 160 nm and a solid content of 20%.

Preparation of Colorant Particle Dispersion Liquid 2

Carbon black (trade name: REGAL 330, manufactured by Cabot Supermetal K. K.): 50 parts Anion surfactant (trade name: NEWREX R, manufactured by NOF Corporation): 2 parts Ion exchanged water: 198 parts The above-mentioned components are mixed and dispersed in a homogenizer (trade name: ULTRATURRAX, manufactured by IKA) for 10 minutes. The dispersion is dispersed using a cross-collision type wet-type pulverizer (trade name: ULTIMIZER, manufactured by Sugino Machine Ltd.) under the pressure of 245 Mpa for 15 minutes to give colorant particle dispersion liquid 2 having a center particle size of the colorant particles of 180 nm and a solid content of 20.0%.

Preparation of Releasing Agent Particle Dispersion Liquid 1

Olefin wax (melting temperature: 88° C.): 60 parts

Ionic surfactant (trade name: NEOGEN RK, manufactured by Daiichi Kogyo Seiyaku Co., Ltd.): 1.8 parts Ion exchanged water: 238 parts The above-mentioned components are heated to 100° C. and fully dispersed in a homogenizer (trade name: ULTRATURRAX T50, manufactured by IKA). The dispersion is then heated to 110° C. in a pressure ejection Gaul in homogenizer and dispersed for 1 hour to give releasing agent particle dispersion liquid 1 having a center diameter of 180 nm and a solid content of 20%.

Preparation of Toner 1

Resin particle dispersion liquid (1): 100 parts

Resin particle dispersion liquid (3): 300 parts

Resin particle dispersion liquid (7): 300 parts

Colorant particle dispersion liquid 1: 40 parts

Releasing agent particle dispersion liquid 1: 60 parts

The above-mentioned components are put into a round stainless flask, 2.0 parts of ionic surfactant (trade name: NEOGEN RK) is added, and the mixture is fully mixed and dispersed by stirring. 1N aqueous solution of nitric acid is then added dropwise to adjust the pH to 3.5, 0.60 part of polyaluminum chloride is added, and the mixture is dispersed using a homogenizer (trade name: ULTRATURRAX, manufactured by IKA). The dispersion is heated to 48° C. while the flask is stirred in a heating oil bath. The dispersion is maintained at 48° C. for 40 minutes, and a mixed liquid of 100 parts of resin particle dispersion liquid (3) and 100 parts of resin particle dispersion liquid (7) is gently added.

1 N aqueous solution of sodium hydroxide is then added to adjust the pH in the system to 7.0. The stainless flask is sealed, gradually heated to 90° C. while the dispersion is continuously stirred using a magnet seal, and hold at 90° C. for 3 hours.

After the reaction is completed, the reaction mixture is cooled, filtered, sufficiently washed with ion exchanged water, and subjected to solid-liquid separation by Nutsche aspiration filtration. The solid is further dispersed in 1 L of ion exchanged water at 40° C. and washed by stirring at 300 rpm for 15 minutes. This operation is repeated further 5 times, and when the pH of the filtrate reaches 7.5 and the electric conductivity reaches 7.0 μS/cmt, the solid is subjected to solid-liquid separation using a No. 5A filter paper by Nutsche aspiration filtration. Vacuum drying is then continued for 12 hours to give a toner 1.

The volume average diameter D50 is determined to be 5.9 μm, and the particle size distribution coefficient GSDv is determined to be 1.25, by the measurement of particle size. Furthermore, the shape factor SF1 of the particles obtained from the observation of the shape using an image analysis device (trade name: LUZEX, manufactured by Nireco Corporation) is 136, and exhibits potato-like shape.

Preparation of Toner 2

A toner 2 is obtained according to a similar manner to the preparation of the toner 1 except that the resin particle dispersion liquid (7) is replaced with the resin particle dispersion liquid (8). This toner has a volume average diameter D50 of 5.7 μm and a particle size distribution coefficient GSDv of 1.27. Furthermore, the shape factor SF1 of the particles obtained from the observation of the shape using an image analysis device (trade name: LUZEX, manufactured by Nireco Corporation) is 133, and exhibits potato-like shape.

Preparation of Toner 3

A toner 3 is obtained according to a similar manner to the preparation of the toner 1 except that the resin particle dispersion liquid (3) is replaced with the resin particle dispersion liquid (4). This toner has a volume average diameter D50 of 6.0 μm and a particle size distribution coefficient GSDv of 1.24. Furthermore, the shape factor SF1 of the particles obtained from the observation of the shape using an image analysis device (trade name: LUZEX, manufactured by Nireco Corporation) is 139, and exhibits potato-like shape.

Preparation of Toner 4

A toner 4 is obtained according to a similar manner to the preparation of the toner 1 except that the resin particle dispersion liquid (3) is replaced with the resin particle dispersion liquid (5). This toner has a volume average diameter D50 of 6.0 μm and a particle size distribution coefficient GSDv of 1.23. Furthermore, the shape factor SF1 of the particles obtained from the observation of the shape using an image analysis device (trade name: LUZEX, manufactured by Nireco Corporation) is 140, and exhibits potato-like shape.

Preparation of Toner 5

A toner 5 is obtained according to a similar manner to the preparation of the toner 1 except that the colorant particle dispersion liquid 1 is replaced with the colorant particle dispersion liquid 2. This toner has a volume average diameter D50 of 5.8 μm and a particle size distribution coefficient GSDv of 1.24. Furthermore, the shape factor SF1 of the particles obtained from the observation of the shape using an image analysis device (trade name: LUZEX, manufactured by Nireco Corporation) is 136, and exhibits potato-like shape.

Preparation of Toner 6

A toner 6 is obtained according to a similar manner to the preparation of the toner 1 except that the resin particle dispersion liquid (3) is replaced with the resin particle dispersion liquid (2) and the resin particle dispersion liquid (7) is replaced with the resin particle dispersion liquid (6). This toner has a volume average diameter D50 of 5.7 μm and a particle size distribution coefficient GSDv of 1.23. Furthermore, the shape factor SF1 of the particles obtained from the observation of the shape using an image analysis device (trade name: LUZEX, manufactured by Nireco Corporation) is 140, and exhibits potato-like shape.

Preparation of Toner 7

A toner 7 is obtained according to a similar manner to the preparation of the toner 1 except that the resin particle dispersion liquid (3) is replaced with the resin particle dispersion liquid (5) and the resin particle dispersion liquid (7) is replaced with the resin particle dispersion liquid (9). This toner has a volume average diameter D50 of 5.9 μm and a particle size distribution coefficient GSDv of 1.24. Furthermore, the shape factor SF1 of the particles obtained from the observation of the shape using an image analysis device (trade name: LUZEX, manufactured by Nireco Corporation) is 133, and exhibits potato-like shape.

Preparation of Toner 8

A toner 8 is obtained according to a similar manner to the preparation of the toner 1 except that the resin particle dispersion liquid (3) is replaced with the resin particle dispersion liquid (5) and the resin particle dispersion liquid (7) is replaced with the resin particle dispersion liquid (8). This toner has a volume average diameter D50 of 5.8 μm and a particle size distribution coefficient GSDv of 1.23. Furthermore, the shape factor SF1 of the particles obtained from the observation of the shape using an image analysis device (trade name: LUZEX, manufactured by Nireco Corporation) is 131, and exhibits potato-like shape.

<Addition of External Additives>

100 parts of toner 1, 0.8 part of hydrophobic titania treated with decylsilane having an average particle size of 15 nm, 1.1 parts of hydrophobic silica having an average particle size of 30 nm (trade name: NY50, manufactured by Japan Aerosil Co., Ltd.), and 1.0 part of hydrophobic silica having an average particle size of 100 nm (trade name: X24, manufactured by Shin-Etsu Chemical Co., Ltd.,) are blended using a Henschel mixer at a peripheral speed of 32 m/s* for 10 minutes, and the large particles are removed by a 45 μm mesh sieve to give an externally-added toner 1. In a similar manner, externally-added toners 2 to 8 are prepared from the toners 2 to 8, respectively.

<Preparation of Carrier>

Ferrite (trade name: EFC-35B, manufactured by Powdertech Co. Ltd., weight average particle size; 35μ): 100 parts Toluene: 13.5 parts Methyl methacrylate-perfluorooctyl methacrylate copolymer: 2.3 parts (polymerization ratio: 90:10, weight average molecular weight: 49,000)

Carbon black (trade name: VXC72, manufactured by Cabot Supermetal K. K.): 0.3 part Melamine resin particles (trade name: EPOSTAR S, manufactured by Nippon Shokubai Co., Ltd.): 0.3 part The above-mentioned components other than ferrite are dispersed in a sand mill for 1 hour to prepare a solution for forming a resin coating layer. The solution for forming a resin coating layer and ferrite are then put into a vacuum degassing kneader, the mixture is stirred for 20 minutes at the temperature of 60° C. under reduced pressure to form a resin coating layer on the ferrite to give a carrier. The volume resistance is $2\times10^{11}$ Ωcm.

<Preparation of Developing Agent>

100 parts of carrier is add to 7 parts of externally-added toner 1, and the mixture is mixed in a ball mill for 5 minutes to give a developing agent 1. In a similar manner, developing agents 2 to 8 are also prepared from the externally-added toners 2 to 8, respectively. The ammonium ion concentrations in the toners included in the developing agents are shown in Table 1.

Examples 1 to 12 and Comparative Examples 1 to 8

Evaluation of Image Degradation

Figure 4:
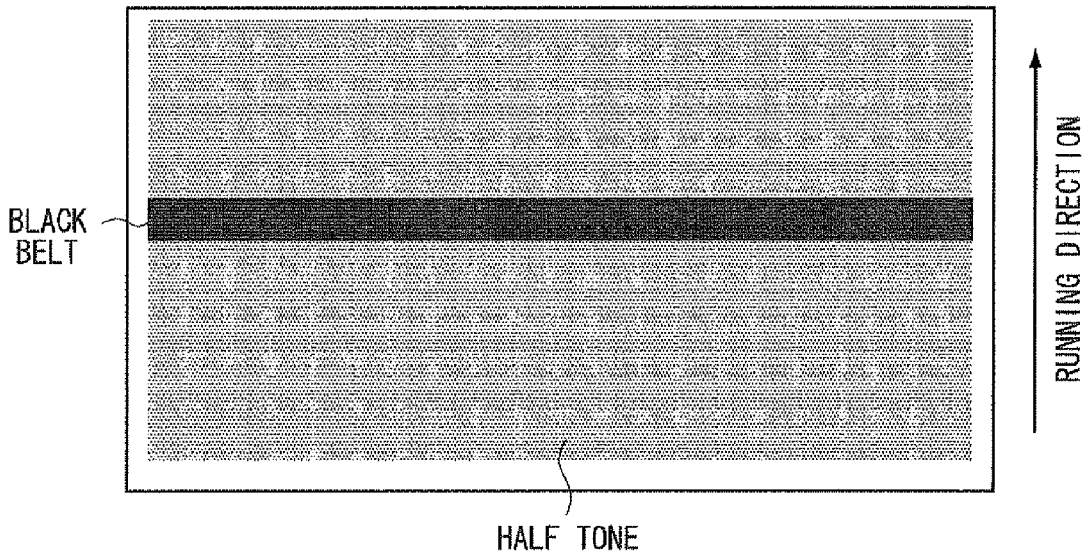
FIG. 4 is a drawing for the explanation on an image prepared for the evaluation of image degradation.

The photoreceptor shown in Table 1 is equipped on a full color printer (a modified machine of DOCUCENTRE 400CP (trade name, manufactured by Fuji Xerox Co., Ltd.), which is modified so that a developing agent is set on only a developing unit at the yellow position), and the developing agent shown in Table 1 is set on the predetermined developing unit and the cartridge at the yellow position. Full-color mode output is continuously performed without setting other black, cyan and magenta developing units. As shown in FIG. 4, the output image is a combination of a band perpendicular to the running direction (amount of the toner developed: 4.0 to 5.0 g/m$^2$) and an overall half tone image, and the width of the band image is adjusted so that the amount of the toner developed becomes 20 g per 1000 sheets. Under the environment of high temperature and high humidity (28° C., 85% RH), a test is performed for 30 days in a mode of continuously printing on 5000 sheets per a day, leaving the sheets as they are, and performing continuous output on additional 5000 sheets on the next morning (output on 150,000 sheets in total). Furthermore, another test is performed for 30 days under environment of low temperature and low humidity (10° C., 15% RH) in the same mode (output on 150,000 sheets in total). During these tests, an overall half tone output test at the concentration of 20% is performed by using A3 paper on the image first obtained on the next morning after the printing test, and the image degradation due to the discharge products is visually evaluated according to the following criteria. The result is shown in Table 1. The "image degradation is not observed" and "image degradation is generated" in Table 1 are defined as follows.

"Image degradation is not observed": one dot line is fully resolved.

"Image degradation generated": one dot line is not resolved.

[Evaluation of Abrasion Resistance]

The amount of abrasion of the photoreceptor in the above-mentioned test is measured and converted to an abrasion ratio per 1000 revolutions (nm/kcycle). The obtained result is shown in Table 1. Where the abrasion ratio is 5 nm/kcycle or less, the abrasion resistance is considered to be sufficient, which is shown by the symbol "A" in the column right to the column showing the abrasion ratio, and where the abrasion ratio exceeds 5 nm/kcycle, the abrasion resistance is considered to be insufficient, which is shown by the symbol "B".

TABLE 1

| | Photoreceptor used | Developing agent used | Ammonium ion concentration in toner (ppm) | Evaluation of abrasion resistance: Abrasion ratio (nm/kcycle) | Determination | Evaluation of image degradation |
|---|---|---|---|---|---|---|
| Example 1 | Photoreceptor 1 | Developer 1 | 60 | 3.7 | A | Image degradation is not observed |
| Example 2 | Photoreceptor 1 | Developer 2 | 150 | 3.5 | A | Image degradation is not observed |
| Example 3 | Photoreceptor 1 | Developer 3 | 210 | 3.6 | A | Image degradation is not observed |
| Example 4 | Photoreceptor 1 | Developer 4 | 280 | 3.7 | A | Image degradation is not observed |
| Example 5 | Photoreceptor 2 | Developer 1 | 60 | 4.0 | A | Image degradation is not observed |
| Example 6 | Photoreceptor 2 | Developer 2 | 150 | 3.8 | A | Image degradation is not observed |
| Example 7 | Photoreceptor 2 | Developer 3 | 210 | 3.7 | A | Image degradation is not observed |
| Example 8 | Photoreceptor 2 | Developer 4 | 280 | 3.6 | A | Image degradation is not observed |
| Example 9 | Photoreceptor 3 | Developer 1 | 60 | 4.5 | A | Image degradation is not observed |
| Example 10 | Photoreceptor 3 | Developer 2 | 150 | 4.2 | A | Image degradation is not observed |
| Example 11 | Photoreceptor 3 | Developer 3 | 210 | 4.4 | A | Image degradation is not observed |
| Example 12 | Photoreceptor 3 | Developer 4 | 280 | 4.4 | A | Image degradation is not observed |
| Comparative example 1 | Base photoreceptor | Developer 1 | 60 | 23 | B | Image degradation is not observed. However, line images due to scratches on the photoreceptor are observed. |
| Comparative example 2 | Photoreceptor 1 | Developer 5 | 40 | 3.6 | A | Image degradation is generated on the $3^{rd}$ morning under low temperature and low humidity. |
| Comparative example 3 | Photoreceptor 2 | Developer 5 | 40 | 3.8 | A | Image degradation is generated on the $4^{th}$ morning under low temperature and low humidity. |
| Comparative example 4 | Photoreceptor 3 | Developer 5 | 40 | 4.6 | A | Image degradation is generated on the $10^{th}$ morning under low temperature and low humidity. |
| Comparative example 5 | Photoreceptor 1 | Developer 6 | 350 | 3.7 | A | Image degradation is generated on the $10^{th}$ morning under high temperature and high humidity. |
| Comparative example 6 | Photoreceptor 2 | Developer 6 | 350 | 3.8 | A | Image degradation is generated on the $15^{th}$ morning under high temperature and high humidity. |
| Comparative example 7 | Photoreceptor 3 | Developer 6 | 350 | 4.3 | A | Image degradation is generated on the $20^{th}$ morning under high temperature and high humidity. |
| Comparative example 8 | Photoreceptor 3 | Developer 8 | 310 | 4.1 | A | Image degradation is not observed. Problematic level of fogging is generated on the $5^{th}$ day under high temperature and high humidity. |

In the test for evaluating the image quality retention property, the toner transfer efficacy is generally 95% to 98%. The transfer efficacy is calculated by the following equation:

Transfer amount of the black band image portion on the photoreceptor to the transfer belt/Developing amount of the black band image portion on the photoreceptor×100(%).

The residual transfer toner is cleaned away on the cleaning portion of the photoreceptor.

In Examples 1 to 12, high quality images are obtained on the first morning after continuous printing. On the other hand, in Comparative Examples 2 to 7 that do not show the predetermined ammonium ion concentration, image degradation is observed during the printing on the first morning. The image degradation is eliminated after subsequent printing on 100 sheets or more, however, it is observed again in the first printing on the next morning and problematic.

Furthermore, Comparative Example 1 in which a curable resin such as a phenol resin, an epoxy resin and a melamine resin is not included in the surface layer of the photoreceptor shows no problem during the image test up to the $10^{th}$ day, however black lines are observed on the image on the $11^{th}$ day, and the lines are not eliminated even after continuous printing. Fine scratches running in the direction of revolution are observed on the surface of the photoreceptor, and an obvious adhered substance is observed on a portion thereof. The black lines on the image are generated due to this adhered substance.

What is claimed is:

1. An image forming apparatus, comprising:

an electrophotographic photoreceptor;

a charging unit that charges a surface of the electrophotographic photoreceptor;

an exposure unit that exposes the charged surface of the electrophotographic photoreceptor to form an electrostatic latent image;

a developing unit that develops the electrostatic latent image using a toner to form a toner image;

a transfer unit that transfers the toner image from the surface of the electrophotographic photoreceptor to a transfer material or an intermediate transfer medium;

a fixing unit that fixes the transferred toner image on a recording material; and a cleaning unit that removes toner remaining on the surface of the electrophotographic photoreceptor after completion of the transfer of the toner image;

the electrophotographic photoreceptor having an outermost layer containing a charge transporting material and at least one curable resin selected from the group consisting of a phenol resin, an epoxy resin and a melamine resin, the toner including a polyester resin, the polyester resin having been functionalized to include an ammonium ion, and the toner having an ammonium ion concentration as determined by ion chromatography of from about 50 ppm to about 300 ppm.

2. The image forming apparatus of claim 1, wherein, in the outermost layer of the electrophotographic photoreceptor, the charge transporting material comprises at least one functional group selected from the group consisting of a hydroxyalkyl group, a hydroxyalkoxy group, a hydroxyalkylthio group and a hydroxyphenyl group that may have a substituent, and the curable resin is a melamine resin.

3. The image forming apparatus of claim 1, wherein the charge transporting material is a compound represented by the following formula (I):

$$F—((—R_1—X)_{n1}R_2—Y)_{n2} \quad (I)$$

wherein, in the formula (I), F represents an organic group derived from an arylamine derivative, $R_1$ and $R_2$ each independently represent a linear or branched alkylene group having 1 to 5 carbon atoms, n1 represents 0 or 1, and n2 represents an integer of 1 to 4, X represents an oxygen, NH, or sulfur atom, and Y represents —OH, —$OCH_3$, —$NH_2$, —SH, or —COOH.

4. The image forming apparatus of claim 1, wherein the toner includes a releasing agent.

5. The image forming apparatus of claim 4, wherein the releasing agent melts at a temperature of from about 70° C. to about 140° C. and exhibits melt viscosity of from about 1 to 200 centipoises.

6. The image forming apparatus of claim 4, wherein the addition amount of the releasing agent to the toner is from about 1% to about 15% by weight.

7. The image forming apparatus of claim 1, wherein the toner includes an amorphous polyester resin, and the amorphous polyester resin has a softening point of from about 90° C. to about 150° C., a glass transition temperature of from about 55° C. to about 75° C., a number average molecular weight of from about 2000 to about 10000 and a weight average molecular weight of from about 8000 to about 150000.

8. The image forming apparatus of claim 1, wherein the toner includes a crystalline polyester resin.

9. The image forming apparatus of claim 1, wherein the volume average particle size of the toner is from about 3 μm to about 9 μm.

10. The image forming apparatus of claim 1, wherein the volume average particle size distribution index GSDv of the toner is not more than about 1.30.

11. A process cartridge that is removable from and attachable to a main body of an image forming apparatus, comprising at least:

an electrophotographic photoreceptor; and a developing unit that develops, using a toner, an electrostatic latent image formed on the electrophotographic photoreceptor to form a toner image;

the electrophotographic photoreceptor having an outermost layer containing a charge transporting material and at least one curable resin selected from the group consisting of a phenol resin, an epoxy resin and a melamine resin, the toner including a polyester resin, the polyester resin having been functionalized to include an ammonium ion, and the toner having an ammonium ion concentration determined by ion chromatography of from about 50 ppm to about 300 ppm.

12. The process cartridge of claim 11, wherein, in the outermost layer of the electrophotographic photoreceptor, the charge transporting material comprises at least one functional group selected from the group consisting of a hydroxyalkyl group, a hydroxyalkoxy group, a hydroxyalkylthio group, and a hydroxyphenyl group that may have a substituent, and the curable resin is a melamine resin.

13. The process cartridge of claim 11, wherein the charge transporting material is a compound represented by the following formula (I):

$$F—((—R_1—X)_{n1}R_2—Y)_{n2} \quad (I)$$

wherein, in the formula (I), F represents an organic group derived from an arylamine derivative, $R_1$ and $R_2$ each independently represent a linear or branched alkylene group having 1 to 5 carbon atoms, n1 represents 0 or 1, and n2 represents an integer of 1 to 4, X represents an oxygen, NH, or sulfur atom, and Y represents —OH, —$OCH_3$, —$NH_2$, —SH, or —COOH.

14. The process cartridge of claim 11, wherein the toner includes a releasing agent.

15. The process cartridge of claim 14, wherein the releasing agent melts at a temperature of from about 70° C. to about 140° C. and exhibits melt viscosity of from about 1 to about 200 centipoises.

16. The process cartridge of claim 14, wherein the addition amount of the releasing agent to the toner is from about 1% to about 15% by weight.

17. The process cartridge of claim 11, wherein the toner includes an amorphous polyester resin, and the amorphous polyester resin has a softening point of from about 90° C. to about 150° C., a glass transition temperature of from about 55° C. to about 75° C., a number average molecular weight of from about 2000 to about 10000 and a weight average molecular weight of from about 8000 to about 150000.

18. The process cartridge of claim 11, wherein the toner includes a crystalline polyester resin.

19. The process cartridge of claim 11, wherein the volume average particle size of the toner is from about 3 μm to about 9 μm.

20. The process cartridge of claim 11, wherein the volume average particle size distribution index GSDv of the toner is not more than about 1.30.

* * * * *